US010955146B2

(12) United States Patent
Shibuya et al.

(10) Patent No.: US 10,955,146 B2
(45) Date of Patent: Mar. 23, 2021

(54) FAN AND REFRIGERATION APPARATUS INCLUDING FAN

(71) Applicant: DAIKIN INDUSTRIES, LTD., Osaka (JP)

(72) Inventors: Kento Shibuya, Osaka (JP); Tsunehisa Sanagi, Osaka (JP); Kouji Somahara, Osaka (JP); Kazuyasu Matsui, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 4 days.

(21) Appl. No.: 16/469,555

(22) PCT Filed: Dec. 8, 2017

(86) PCT No.: PCT/JP2017/044153

§ 371 (c)(1),
(2) Date: Jun. 13, 2019

(87) PCT Pub. No.: WO2018/110445

PCT Pub. Date: Jun. 21, 2018

(65) Prior Publication Data

US 2020/0088418 A1 Mar. 19, 2020

(30) Foreign Application Priority Data

Dec. 15, 2016 (JP) ..... JP2016-243043

(51) Int. Cl.
*F04D 29/16* (2006.01)
*F24F 1/0029* (2019.01)
(Continued)

(52) U.S. Cl.
CPC ..... *F24F 1/0029* (2013.01); *F04D 29/164* (2013.01); *F04D 29/326* (2013.01); *F04D 29/526* (2013.01); *F24F 1/0011* (2013.01)

(58) Field of Classification Search
CPC ..... F28D 1/024; F04D 29/164; F04D 29/326; F24F 1/0029; F24F 1/0011
See application file for complete search history.

(56) References Cited

U.S. PATENT DOCUMENTS 3,842,902 A 10/1974 Poslusny
5,443,363 A 8/1995 Cho
(Continued)

FOREIGN PATENT DOCUMENTS

JP 9-505375 A 5/1997
KR 20030020996 A * 3/2003
WO 2015/125486 A1 8/2015

OTHER PUBLICATIONS

International Search Report of corresponding PCT Application No. PCT/JP2017/044153 dated Mar. 6, 2018.
(Continued)

*Primary Examiner* — Eric S Ruppert
(74) *Attorney, Agent, or Firm* — Global IP Counselors, LLP

(57) ABSTRACT

A fan includes a core part, a vanes, a ring part and a flow rectifying member. The ring part includes first second and third parts. The first part includes a first end overlapping with a flow rectifying member end and extends axially on a radially inner side of the flow rectifying member. The second part includes a second end spaced from the flow rectifying member end, overlapping with the flow rectifying member, and connected to the first end. The third part is connected to the second end, and extends on the radially outer side of the flow rectifying member end. The second end overlaps with a virtual point reached by the flow rectifying member end being linearly extended toward an upstream side. A first dimension, a radial length of the third
(Continued)

part, is at least 0.5 times a first straight-line distance between the flow rectifying member end and the virtual point.

8 Claims, 14 Drawing Sheets

(51) Int. Cl.

| | |
|---|---|
| ***F04D 29/32*** | (2006.01) |
| ***F04D 29/52*** | (2006.01) |
| ***F24F 1/0011*** | (2019.01) |

(56) References Cited

U.S. PATENT DOCUMENTS

| | | | | |
|---|---|---|---|---|
| 5,489,186 | A * | 2/1996 | Yapp | F01D 5/141 415/208.3 |
| 2003/0161728 | A1 | 8/2003 | Cho et al. | |
| 2007/0160468 | A1* | 7/2007 | Tsubota | F01P 5/06 415/173.6 |
| 2016/0305448 | A1* | 10/2016 | Hong | F01P 1/06 |
| 2016/0333893 | A1 | 11/2016 | Kondou et al. | |

OTHER PUBLICATIONS

European Search Report of corresponding EP Application No. 17 88 1140.2 dated Nov. 7, 2019.
International Preliminary Report of corresponding PCT Application No. PCT/JP2017/044153 dated Jun. 27, 2019.

* cited by examiner

FAN AND REFRIGERATION APPARATUS INCLUDING FAN

CROSS-REFERENCE TO RELATED APPLICATIONS

This U.S. National stage application claims priority under 35 U.S.C. § 119(a) to Japanese Patent Application No. 2016-243043, filed in Japan on Dec. 15, 2016, the entire contents of which are hereby incorporated herein by reference.

TECHNICAL FIELD

The present invention relates to a fan, and a refrigeration apparatus including the fan.

BACKGROUND ART

Conventionally, fans which generate an air flow in an air conditioner or the like are known. For example, WO 2015/125486 discloses a fan which generates an air flow flowing in the rotation axis direction. The fan disclosed in WO 2015/125486 includes a plurality of vanes radially extending from a core part as seen in the rotation axis direction, a ring part connected to respective tips of the vanes, and a flow rectifying member which is cylindrical and extends along the rotation axis direction.

In the fan disclosed in WO 2015/125486, a clearance is formed between the ring part and the flow rectifying member so as to allow the ring part to rotate with the vanes. Through the clearance, part of an air flow on the secondary side (the blow-out side) reversely flows toward the primary side (the intake side). The air having reversely flowed in such a manner (i.e., backflow air) merges with air to be taken into the fan (i.e., intake air) (that is, a short-circuit may occur). In order to minimize noises in merging which occur due to the backflow air creating a swirl before merging with the intake air, WO 2015/125486 includes a flange part at the tip of the ring part for rectifying the flow of the backflow air. Thus, WO 2015/125486 prevents the backflow air from generating a swirl.

SUMMARY

With the above-described fan, as the flow rate of the backflow air (the backflow volume) increases, the flow rate of an airflow blown out from the fan (the airflow volume) reduces. That is, reducing the backflow volume increases the airflow volume, contributing to improving the efficiency of the fan. However, WO 2015/125486 mainly discusses reducing the noises, which is achieved by rectifying the backflow air thereby minimizing an occurrence of a swirl. WO 2015/125486 is silent about reducing the backflow volume (that is, improving the efficiency of the fan).

An object of the present invention is to provide a fan with improved efficiency.

A fan according to a first aspect of the present invention includes a core part, a plurality of vanes, a ring part, and a flow rectifying member. The core part is connected to a drive source. The plurality of vanes radially extend from the core part as seen in a rotation axis direction. The ring part is connected to respective tips of the vanes on a radially outer side relative to the vanes. The ring part is ring-like as seen in the rotation axis direction. The flow rectifying member is disposed spaced apart in the radial direction from the ring part. The flow rectifying member is a cylindrical member extending along the rotation axis direction. The flow rectifying member is configured to rectify air sent by the vanes. The ring part includes a first part, a second part, and a third part. The first part includes a first end. The first end overlaps with a flow rectifying member end as seen in the radial direction. The flow rectifying member end is an upstream side end of the flow rectifying member. The first part extends along the rotation axis direction on a radially inner side relative to the flow rectifying member. The second part includes a second end. The second end is spaced apart in the rotation axis direction from the flow rectifying member end. The second end overlaps with the flow rectifying member as seen in the rotation axis direction. The second part is connected to the first end, and extends along the radial direction to reach the second end. The third part is connected to the second end. The third part extends along the radial direction on the radially outer side than the flow rectifying member end. The second end overlaps with a virtual point. The virtual point is reached by the flow rectifying member end being linearly extended toward the upstream side along the rotation axis direction. A first dimension is at least 0.5 times as great as a first distance. The first dimension is a length in the radial direction of the third part. The first distance is a straight-line distance between the flow rectifying member end and the virtual point.

In the fan according to the first aspect of the present invention, the ring part includes the third part connected to the second end which overlaps with the virtual point which is reached by the flow rectifying member end being linearly extended toward the upstream side in the rotation axis direction, the third part extending along the radial direction on the radially outer side than the flow rectifying member end. The first dimension (the length in the radial direction of the third part) is at least 0.5 times as great as the first distance (the straight-line distance between the flow rectifying member end and the virtual point). That is, the third part extends on the radially outer side than the flow rectifying member end by a length which is at least 0.5 times as great as the clearance formed between the ring part and the flow rectifying member. Thus, the third part provides resistance on the backflow air (the air that reversely flows through the clearance between the ring part and the flow rectifying member) flowing toward a point where it merges with the intake air (the air taken into the fan), thereby greatly detours the backflow air flowing toward the merging point. Consequently, the flow path resistance on the backflow air flowing toward the merging point becomes great, whereby the backflow volume (the amount of the backflow air) per unit time reduces. Hence, the efficiency of the fan improves.

As used herein, the expression "extending along the rotation axis direction or the radial direction" does not strictly mean extending in the rotation axis direction or the radial direction, but also means extending while being inclined relative to the rotation axis direction or the radial direction. The expression "radially inner side" refers to the inner circumference side of the fan, and the expression "radially outer side" refers to the outer circumference side of the fan. The expression "upstream side" refers to the side nearer to the intake side of the fan.

As used herein, the expression "ring-like" does not strictly mean ring-like, but also means a substantially annular shape which is substantially annular as a whole while meandering or bending. The expression "cylindrical" does not strictly mean cylindrical, but also means substantially cylindrical including a flare-like shape with its cross section on one end side gradually increasing toward other end, and an hourglass shape with its cross section gradually reducing from the opposite ends.

A fan according to the second aspect of the present invention is the fan according to the first aspect, in which the third part extends in a direction perpendicular to a direction in which the flow rectifying member extends. This simple configuration greatly detours the backflow air flowing toward a point where it merges with the intake air. This reduces the backflow volume at lower costs.

A fan according to the third aspect of the present invention is the fan according to the first aspect or the second aspect, in which the third part extends along the radial direction on the radially outer side than the flow rectifying member end, and then extends along the rotation axis direction. The flow rectifying member end is positioned on the radially inner side relative to the third part. The flow rectifying member end overlaps with the third part as seen in the radial direction. This configuration further greatly detours the backflow air flowing toward a point where it merges with the intake air. This further reduces the backflow volume and further improves the efficiency of the fan.

A fan according to a fourth aspect of the present invention is the fan according to any of the first to third aspects, in which the flow rectifying member is a bell mouth disposed on the downstream side relative to the vanes. This greatly detours the backflow air passing through the clearance between the bell mouth disposed on the blow-out side relative to the vanes and the ring part. Hence, this improves the efficiency of the fan including the bell mouth and the ring part.

A fan according to a fifth aspect of the present invention is the fan according to any of the first to fourth aspects, in which the first distance falls within a range of 5 mm to 15 mm inclusive. The first dimension is 4 mm or more. This surely detours the backflow air flowing toward a point where it merges with the intake air while preventing an increase in size of the fan.

A fan according to a sixth aspect of the present invention is the fan according to any of the first to fifth aspects, in which the fan is an axial flow fan configured to send air in the rotation axis direction. This improves the efficiency of the axial flow fan including the flow rectifying member and the ring part.

A refrigeration apparatus according to a seventh aspect of the present invention includes the fan according to any of the first to sixth aspects and a heat exchanger. The heat exchanger includes a heat transfer pipe through which a refrigerant flows. The heat exchanger is configured to allow an air flow generated by the fan to exchange heat with the refrigerant.

The refrigeration apparatus according to the seventh aspect of the present invention includes the fan with improved efficiency and the heat exchanger with increased heat exchange volume. Hence, the refrigeration apparatus with improved performance is provided.

With the fan according to the first aspect of the present invention, the third part provides resistance on the backflow air (the air that reversely flows through the clearance formed between the ring part and the flow rectifying member) flowing toward a point where it merges with the intake air (the air taken into the fan), thereby greatly detours the backflow air flowing toward the merging point. Consequently, the flow path resistance on the backflow air flowing toward the merging point becomes great, whereby the backflow volume (the amount of the backflow air) per unit time reduces. Hence, the efficiency of the fan improves.

The fan according to the second aspect of the present invention reduces the backflow volume at lower costs.

The fan according to the third aspect of the present invention further reduces the backflow volume and further improves the efficiency of the fan.

The fan according to the fourth aspect of the present invention including the bell mouth and the ring part exhibits improved efficiency.

The fan according to the fifth aspect of the present invention surely detours the backflow air flowing toward a point where it merges with the intake air while preventing an increase in size of the fan.

The fan according to the sixth aspect of the present invention provides the axial flow fan including the flow rectifying member and the ring part with improved efficiency.

The refrigeration apparatus according to the seventh aspect of the present invention includes the fan with improved efficiency and the heat exchanger with increased heat exchange volume. Hence, the refrigeration apparatus with improved performance is provided.

DETAILED DESCRIPTION OF EMBODIMENT(S)

In the following, with reference to the drawings, a description will be given of a heat-source-side fan 30 (a fan) and a refrigeration apparatus 100 according to an embodiment of the present invention. Note that, the following embodiment is a specific example of the present invention, and does not limit the technical scope of the present invention thereto. The embodiment may be changed as appropriate within a range not deviating from the spirit of the invention.

(1) Refrigeration Apparatus 100

Figure 1:
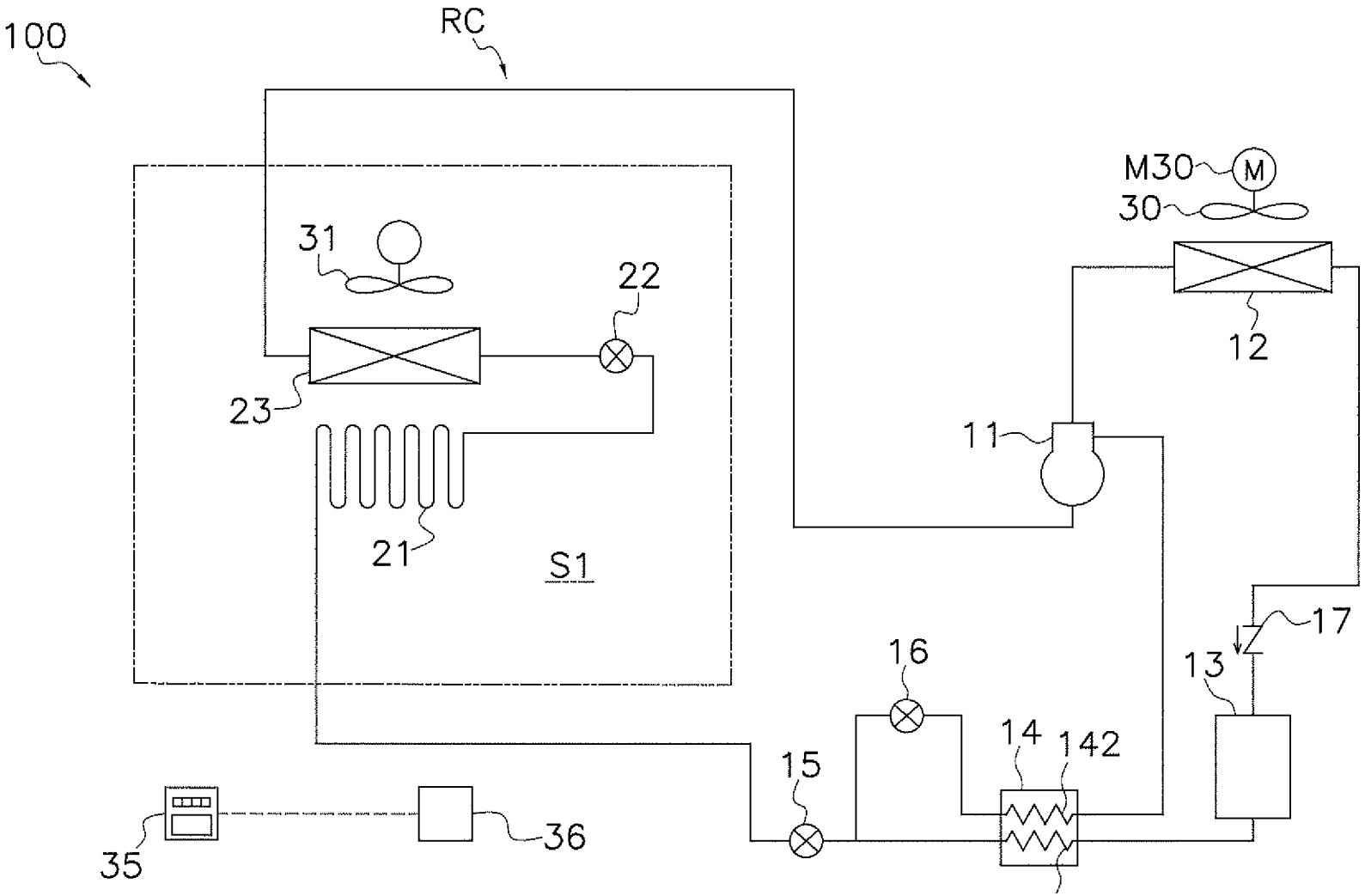
FIG. 1 is a schematic configuration diagram of a refrigeration apparatus according to an embodiment of the present invention.

FIG. 1 is a schematic configuration diagram showing a refrigeration apparatus 100 according to an embodiment of the present invention. The refrigeration apparatus 100 is configured to cool a target space S1, which is the inside of a low-temperature warehouse, the inside of a transfer container, the inside of a showcase at a shop or the like. The refrigeration apparatus 100 includes a refrigerant circuit RC. While the refrigeration apparatus 100 is in operation, the refrigerant circuit RC carries out a vapor-compression refrigeration cycle of subjecting a refrigerant to compression, cooling or condensation, decompression, and heating or evaporation, and thereafter again compression. The refrigerant enclosed in the refrigerant circuit RC is selected as appropriate in accordance with the design specification, the installation environment and the like.

In the refrigeration apparatus 100, the refrigerant circuit RC is formed of various circuit elements being connected to one another via refrigerant pipes. Specifically, the refrigeration apparatus 100 mainly includes, as the circuit elements, a compressor 11, a heat-source-side heat exchanger 12, a receiver 13, a subcooling heat exchanger 14, a heat-source-side first expansion valve 15, a heat-source-side second expansion valve 16, a check valve 17, a heating pipe 21, a service-side expansion valve 22, and a service-side heat exchanger 23.

The refrigeration apparatus 100 further includes, as a fan that generates an air flow functioning as the cooling source or the heating source for the refrigerant, a heat-source-side fan 30 and a service-side fan 31. The refrigeration apparatus 100 further includes a remote controller 35 which is an input device for the user to input various commands. The refrigeration apparatus 100 further includes a controller 36 which exerts control over operations of actuators as circumstances demand.

(1-1) Elements included in Refrigeration Apparatus 100

The compressor 11 is configured to compress the refrigerant. In the present embodiment, the compressor 11 has the closed configuration in which a compressor motor (not shown) rotates a volume-type compressing element (not shown) such as a rotary-type compressing element or a scroll-type compressing element. In the present embodiment, the compressor motor has its the operation frequency controlled by an inverter, whereby the capacity of the compressor 11 is controlled.

The heat-source-side heat exchanger 12 (corresponding to the "heat exchanger" in the claims) is a heat exchanger that functions as a condenser (or a radiator) for the high-pressure refrigerant in the refrigeration cycle. The heat-source-side heat exchanger 12 includes a plurality of heat transfer pipes 121 (see FIG. 4) and a heat transfer fin. The heat-source-side heat exchanger 12 allows the refrigerant in the heat transfer pipes 121 and the outside air (an outside air flow F1 which will be described later) passing around the heat transfer pipes 121 to exchange heat with each other.

The receiver 13 is a container that temporarily stores the refrigerant condensed in the heat-source-side heat exchanger 12.

The subcooling heat exchanger 14 is a heat exchanger that cools the refrigerant temporarily stored in the receiver 13, and disposed on the refrigerant flow downstream side relative to the receiver 13. The subcooling heat exchanger 14 individually includes a first flow path 141 and a second flow path 142, and allows the refrigerant flowing through the first flow path 141 and the refrigerant flowing through the second flow path 142 to exchange heat with each other.

The heat-source-side first expansion valve 15 is an electric expansion valve whose opening degree is controllable, and disposed on the refrigerant flow downstream side relative to the subcooling heat exchanger 14. The heat-source-side first expansion valve 15 decompresses, in accordance with its opening degree, the refrigerant having passed through the first flow path 141.

The heat-source-side second expansion valve 16 is an electric expansion valve whose opening degree is controllable, and disposed on the refrigerant flow upstream side in the second flow path 142 relative to the subcooling heat exchanger 14. The heat-source-side second expansion valve 16 decompresses, in accordance with its opening degree, the refrigerant flowing into the second flow path 142.

The check valve 17 is disposed on the refrigerant flow downstream side relative to the heat-source-side heat exchanger 12 and on the refrigerant flow upstream side relative to the receiver 13. The check valve 17 permits the flow of the refrigerant from the heat-source-side heat exchanger 12 side and blocks the flow of the refrigerant from the receiver 13 side.

The heating pipe 21 is a refrigerant pipe through which the high-pressure refrigerant flows, and configured to melt frost or ice blocks attached to a drain pan (not shown) which receives waste water generated at the service-side heat exchanger 23.

The service-side expansion valve 22 functions as means for decompressing (expanding) the high-pressure refrigerant. The service-side expansion valve 22 is disposed on the refrigerant flow upstream side relative to the service-side heat exchanger 23. The service-side expansion valve 22 decompresses, in accordance with its opening degree, the refrigerant that flows in.

The service-side heat exchanger 23 is a heat exchanger that functions as an evaporator for the refrigerant. The service-side heat exchanger 23 is a heat exchanger disposed in the target space S1 (the inside) for cooling the inside air in the target space S1. The service-side heat exchanger 23 includes a plurality of heat transfer pipes and a heat transfer fin (not shown). The service-side heat exchanger 23 allows the refrigerant in the heat transfer pipe and the air passing around the heat transfer pipe to exchange heat with each other.

The heat-source-side fan 30 is a fan for taking in the air outside the target space S1 (the outside air) and discharging the air having undergone heat exchange with the refrigerant flowing in the heat-source-side heat exchanger 12 to the outside. The heat-source-side fan 30 supplies the heat-source-side heat exchanger 12 with the outside air which functions as the cooling source for the refrigerant flowing through the heat-source-side heat exchanger 12. The heat-source-side fan 30 includes a heat-source-side fan motor M30 serving as the drive source. When the heat-source-side fan motor M30 is in operation, the heat-source-side fan 30 generates the outside air flow F1 that passes through the heat-source-side heat exchanger 12 in the outside of the target space S1 (the outside) (see double-dashed line arrows in FIG. 3). Details of the heat-source-side fan 30 will be given later.

The service-side fan 31 is a fan for taking in the air in the target space S1 (the inside air), allowing the air to pass through the service-side heat exchanger 23 to exchange heat with the refrigerant, and thereafter sending back the air to the target space S1. The service-side fan 31 is disposed in the target space S1. The service-side fan 31 supplies the service-side heat exchanger 23 with the inside air as the heating source for the refrigerant flowing through the service-side heat exchanger 23. The service-side fan 31 includes a service-side fan motor (not shown) which serves as the drive source. When the service-side fan motor is in operation, the service-side fan 31 generates the inside air flow F2 (see broken line arrows in FIG. 3) that passes through the service-side heat exchanger 23 in the target space S1.

The remote controller 35 includes input keys for the user to input various commands. The remote controller 35 is configured to communicate with the controller 36 and transmit signals corresponding to any input commands to the controller 36.

The controller 36 includes a microcomputer that includes a CPU, a memory and the like. The controller 36 is electrically connected to actuators (11, 15, 16, 30, 31 and others) and sensors included in the refrigeration apparatus 100, to exchange signals. The controller 36 controls the operation of actuators as circumstances demand.

(1-2) Flow of Refrigerant in Refrigeration Apparatus 100

The refrigeration apparatus 100 in operation carries out the cooling operation in which the refrigerant enclosed in the refrigerant circuit RC mainly circulates through the elements of, in sequence, the compressor 11, the heat-source-side heat exchanger 12, the receiver 13, the subcooling heat exchanger 14, the heat-source-side first expansion valve 15, the service-side expansion valve 22, and the service-side heat exchanger 23. In the cooling operation, part of the refrigerant having passed through the first flow path 141 of the subcooling heat exchanger 14 branches off to flow through the heat-source-side second expansion valve 16 and the subcooling heat exchanger 14 (the second flow path 142) and thereafter return to the compressor 11.

When the cooling operation starts, in the refrigerant circuit RC, the refrigerant is taken into the compressor 11 and compressed, thereafter discharged. The compressor 11 undergoes the capacity control corresponding to the required cooling load. Specifically, the compressor 11 has its operation frequency controlled such that the suction pressure attains the target value which is set in accordance with the cooling load. The gas refrigerant discharged from the compressor 11 flows into the heat-source-side heat exchanger 12.

The gas refrigerant flowing into the gas side of the heat-source-side heat exchanger 12 exchanges its heat with the outside air sent by the heat-source-side fan 30, that is, dissipates its heat and condenses. The condensed refrigerant flows out from the heat-source-side heat exchanger 12.

The refrigerant flowing out from the heat-source-side heat exchanger 12 flows into the receiver 13. The refrigerant flowing into the receiver 13 is temporarily stored in the receiver 13 as a saturated liquid refrigerant, and thereafter flows out from the receiver 13. The liquid refrigerant flowing out from the receiver 13 flows into the first flow path 141 of the subcooling heat exchanger 14. The liquid refrigerant flowing into the first flow path 141 exchanges heat with the refrigerant flowing through the second flow path 142 in the subcooling heat exchanger 14 and is thereby further cooled, to become the subcooled liquid refrigerant and flow out from the first flow path 141.

Part of the liquid refrigerant flowing out from the first flow path 141 of the subcooling heat exchanger 14 branches off and flows into the heat-source-side second expansion valve 16. The refrigerant flowing into the heat-source-side second expansion valve 16 is decompressed to attain an intermediate pressure, and thereafter flows into the second flow path 142 of the subcooling heat exchanger 14. The refrigerant flowing into the second flow path 142 exchanges heat with the refrigerant flowing through the first flow path 141. The refrigerant flowing out from the second flow path 142 is returned to the middle of the compression stroke of the compressor 11 (that is, injected).

On the other hand, other part of the liquid refrigerant flowing out from the first flow path 141 of the subcooling heat exchanger 14 flows into the heat-source-side first expansion valve 15. The liquid refrigerant flowing into the heat-source-side first expansion valve 15 is decompressed or has its flow rate adjusted in accordance with the opening degree of the heat-source-side first expansion valve 15, to pass through the heating pipe 21 and flows into the service-side expansion valve 22. The refrigerant flowing into the service-side expansion valve 22 is decompressed in accordance with the opening degree of the service-side expansion valve 22, to flow into the service-side heat exchanger 23.

The refrigerant flowing into the service-side heat exchanger 23 exchanges heat with the inside air sent by the service-side fan 31 to evaporate, and becomes a gas refrigerant. The gas refrigerant flows out from the service-side heat exchanger 23. The gas refrigerant flowing out from the service-side heat exchanger 23 is again taken into the compressor 11.

(1-3) Configuration of Refrigeration Apparatus 100

Figure 2:
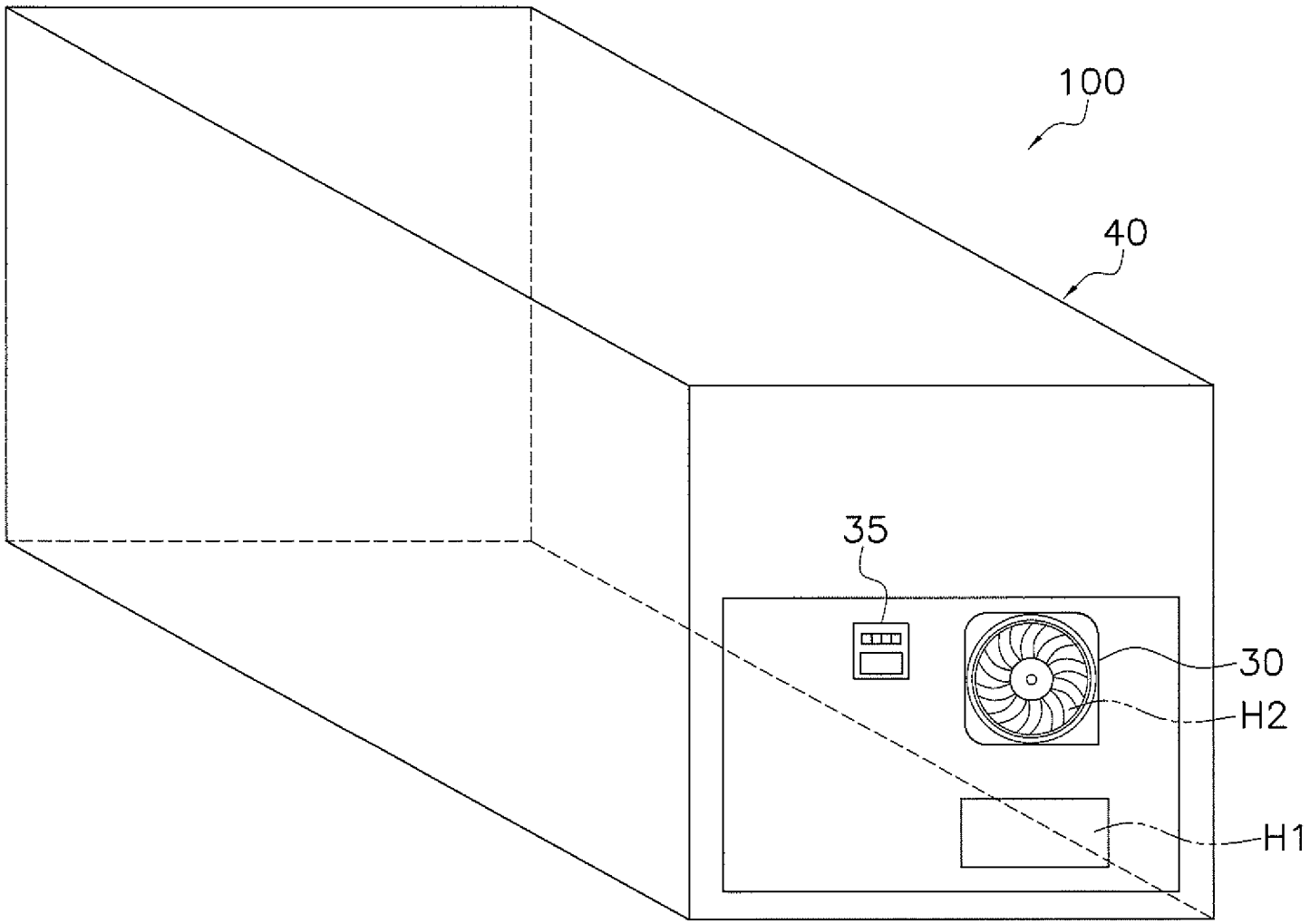
FIG. 2 is an exterior view of the refrigeration apparatus.

FIG. 2 is an exterior view of the refrigeration apparatus 100. The refrigeration apparatus 100 includes a casing 40 that forms a substantial rectangular prism-like shell. Provided at the front surface of the casing 40 are the remote controller 35, an intake hole H1 for the outside air flow F1 to flow in, and a blow-out hole H2 for the outside air flow F1 to flow out. The heat-source-side fan 30 is exposed at the blow-out hole H2. The casing 40 is further provided with a gate which provides access to the target space S1. The gate is provided with a door (not shown) which opens and closes.

Figure 3:
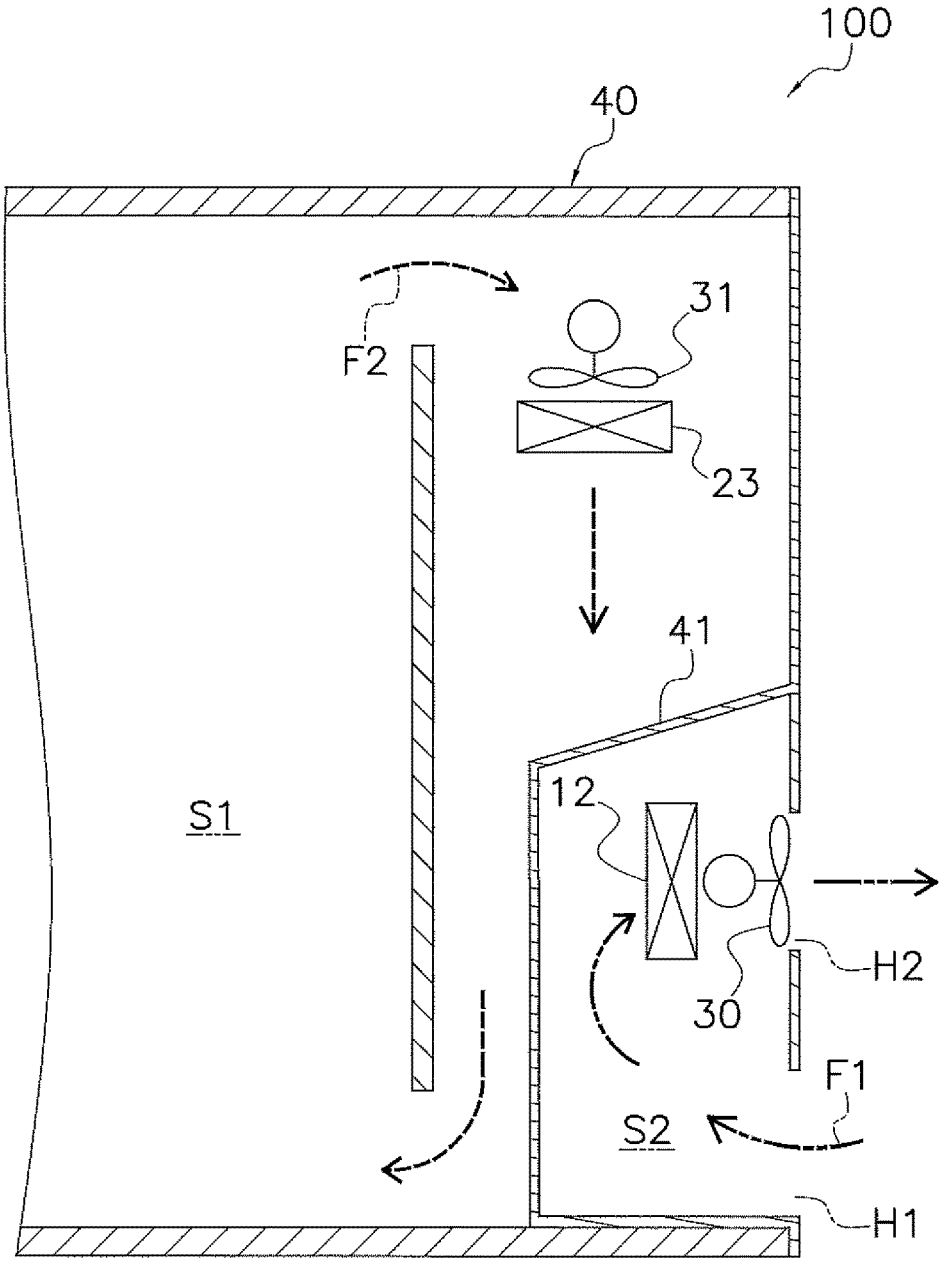
FIG. 3 is a schematic diagram schematically showing a target space and a heat-source-side heat exchanger housing space.

In the casing 40, the target space S1 and a heat-source-side heat exchanger housing space S2 are formed. FIG. 3 is a schematic diagram schematically showing the target space S1 and the heat-source-side heat exchanger housing space S2. The target space S1 and the heat-source-side heat exchanger housing space S2 are partitioned by a partition plate 41.

The target space S1 is a space where any cooling target is housed and cooled, and blocked from the outside space. In the target space S1, various elements including the heating pipe 21, the service-side expansion valve 22, the service-side heat exchanger 23, and the service-side fan 31 are disposed. In the target space S1, the service-side fan 31 in operation generates the inside air flow F2 as represented by broken line arrows in FIG. 3. The inside air flow F2 is a flow of inside air that is taken into the service-side fan 31 in the target space S1 to pass through the service-side heat exchanger 23, and then blown out into the target space S1.

In the heat-source-side heat exchanger housing space S2, various elements including the compressor 11, the heat-source-side heat exchanger 12, the receiver 13, the subcooling heat exchanger 14, the heat-source-side first expansion valve 15, the heat-source-side second expansion valve 16, and the heat-source-side fan 30 are disposed. In the heat-source-side heat exchanger housing space S2, the heat-source-side fan 30 in operation generates the outside air flow F1 as represented by double-dashed arrows in FIG. 3. The outside air flow F1 is a flow of air that flows from the outside of the casing 40 via the intake hole H1 into the heat-source-side heat exchanger housing space S2, and is taken into the heat-source-side fan 30 to pass through the heat-source-side heat exchanger 12, and then blown out to the outside of the casing 40 via the blow-out hole H2.

(2) Details of Heat-Source-Side Fan 30

(2-1) Configuration of Heat-Source-Side Fan 30

Figure 4:
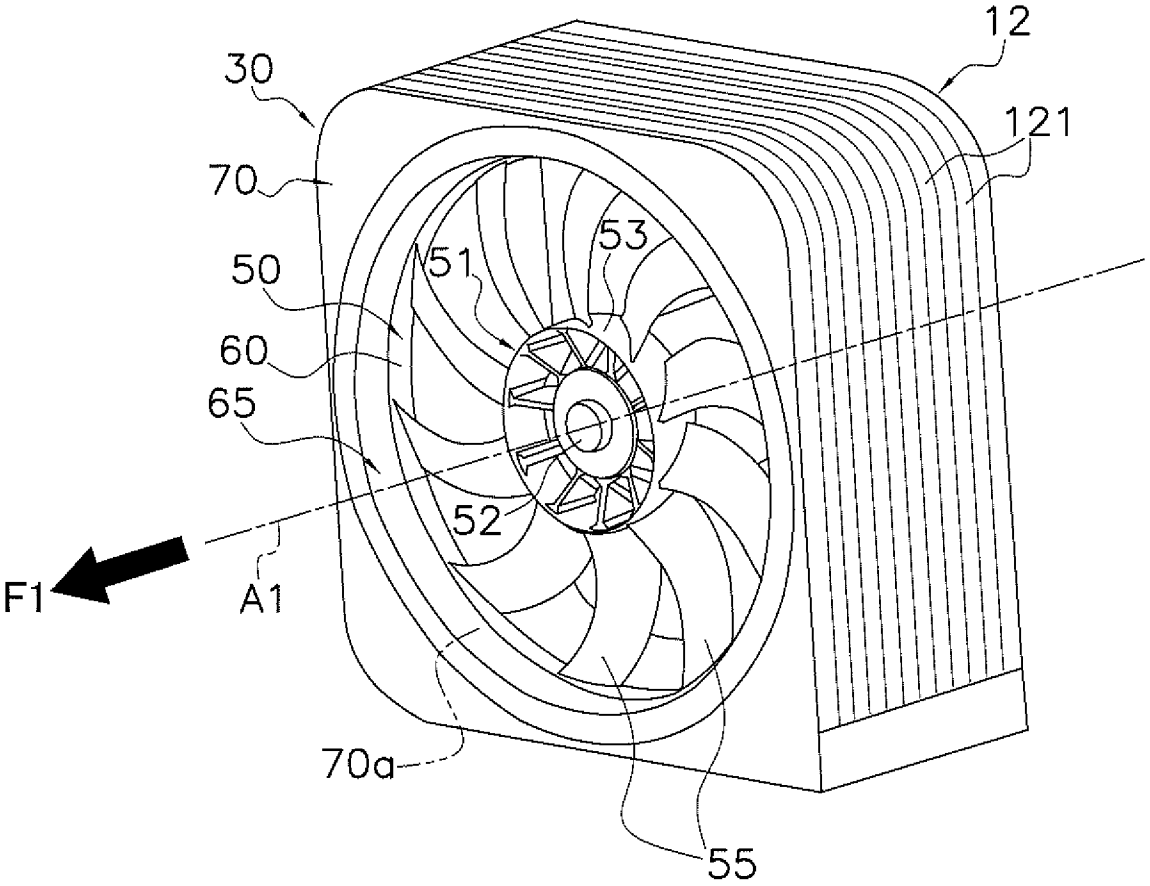
FIG. 4 is a perspective view of a heat-source-side fan as seen from the blow-out side.
Figure 5:
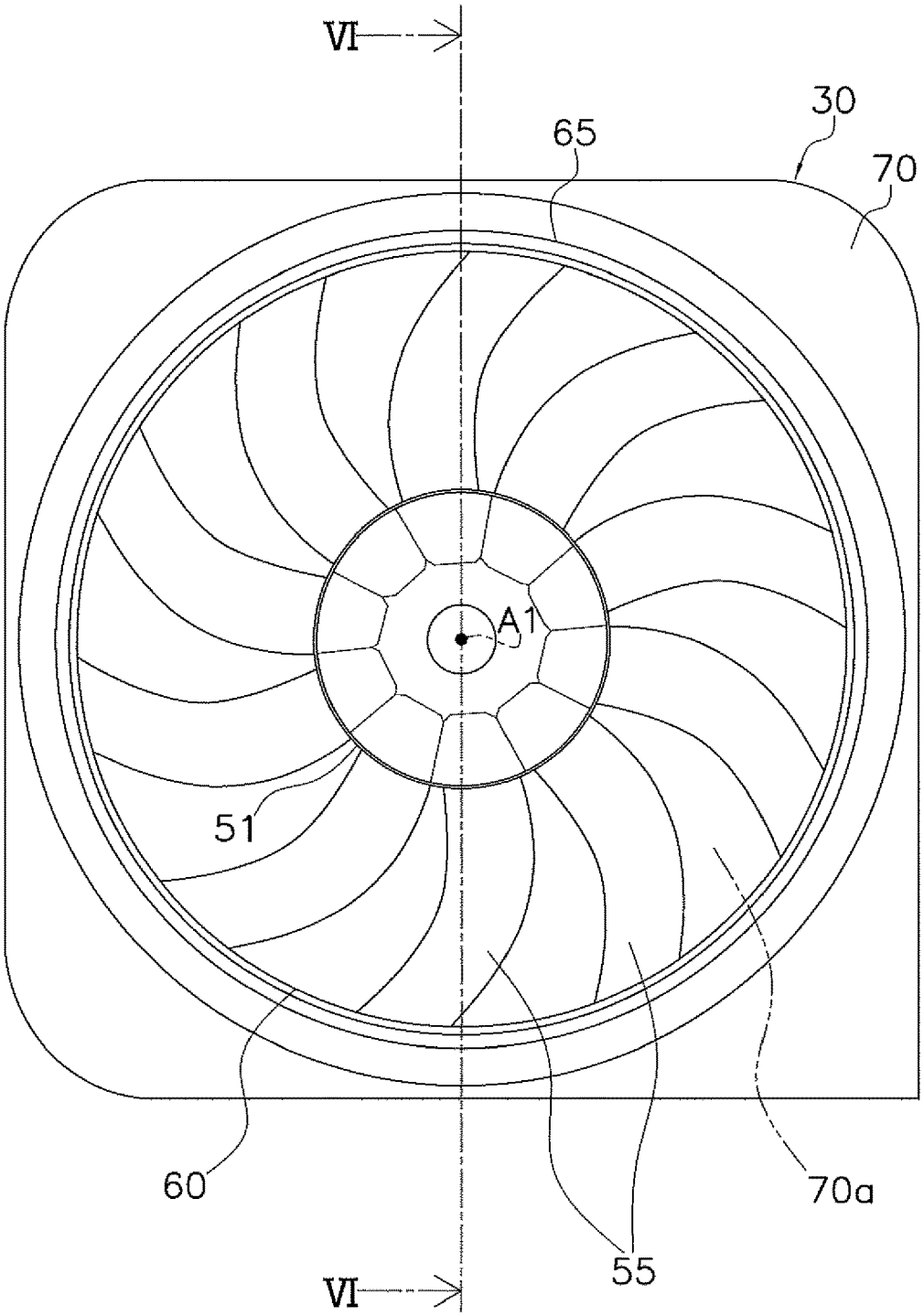
FIG. 5 is a front view of the heat-source-side fan as seen from the blow-out side.
Figure 6:
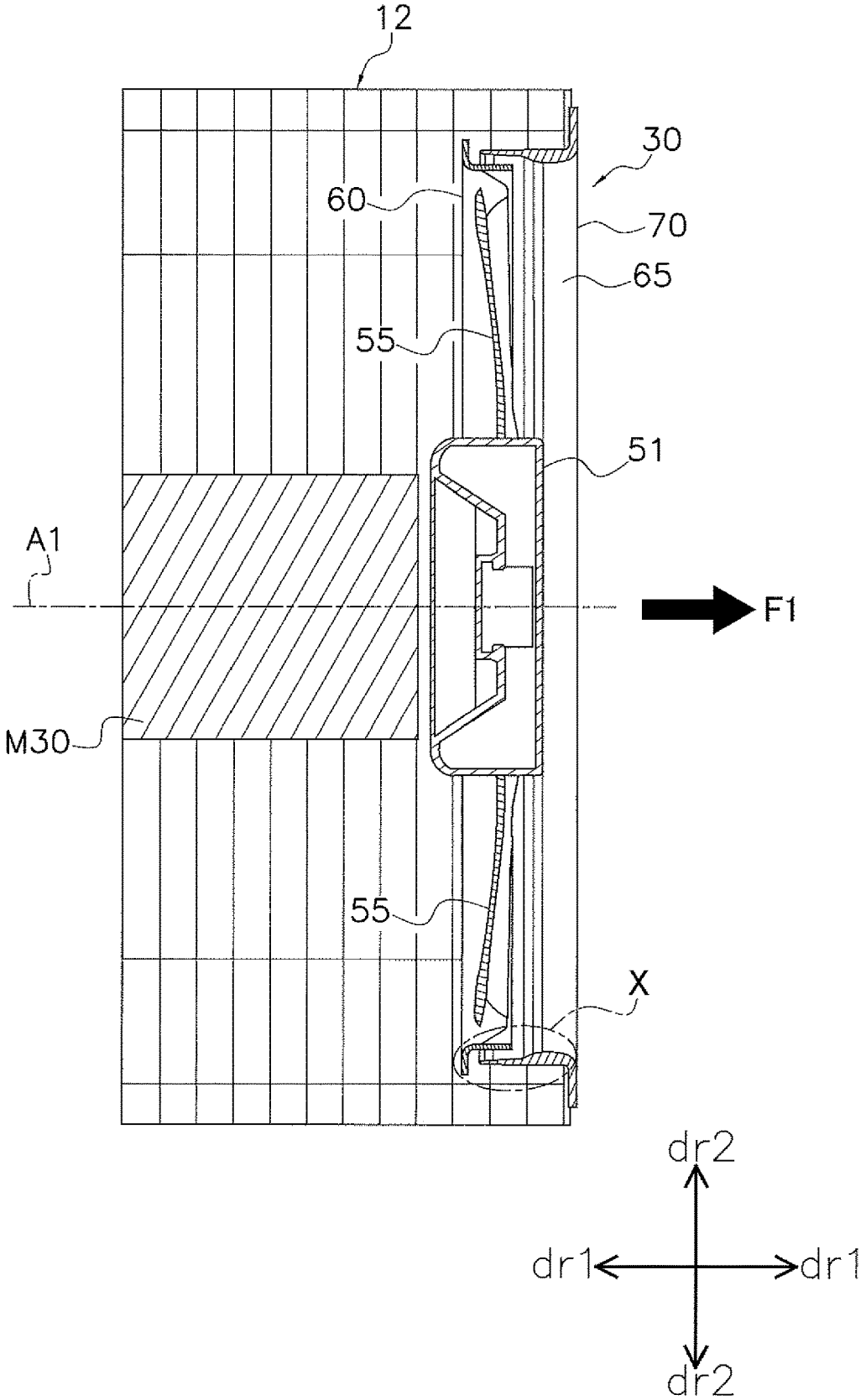
FIG. 6 is a cross-sectional view taken along line VI-VI in FIG. 5.

FIG. 4 is a perspective view of the heat-source-side fan 30 as seen from the blow-out side. FIG. 5 is a front view of the heat-source-side fan 30 as seen from the blow-out side. FIG. 6 is a cross-sectional view taken along line VI-VI in FIG. 5. Arrows "F1" in FIGS. 4 and 6 represent the flow direction of the outside air flow F1.

In the following description, the direction in which a rotation axis A1 of the heat-source-side fan 30 extends is referred to as a rotation axis direction dr1 (see FIG. 6). The radial direction of the heat-source-side fan 30 is referred to as a radial direction dr2 (see FIG. 6). As used herein, the expression "extending in the rotation axis direction dr1 or the radial direction dr2" does not strictly mean extending in the rotation axis direction dr1 or the radial direction dr2, but also means extending while forming an angle falling within a predetermined range (for example, within 45 degrees) relative to the rotation axis direction dr1 or the radial direction dr2. The expression "radially inner side dr2" refers to the inner circumference side of the heat-source-side fan 30, and the expression "radially outer side dr2" refers to the outer circumference side of the heat-source-side fan 30. The expression "upstream side" refers to the side nearer to the intake side of the heat-source-side fan 30, and the expression "downstream side" refers to the side nearer to the blow-out side of the heat-source-side fan 30.

As shown in FIGS. 4 and 6, the heat-source-side fan 30 is coupled to the heat-source-side heat exchanger 12, which has four heat exchange surfaces and whose cross section is substantially quadrangular, via a fixing member (not shown). In more detail, the heat-source-side fan 30 is coupled to the heat-source-side heat exchanger 12, which is disposed to be substantially quadrangular as seen from the rotation axis direction dr1, such that the intake side of the heat-source-side fan 30 is positioned on the downstream side in the outside air flow F1.

The heat-source-side fan 30 is an axial flow fan that sends air in the axial flow direction (the rotation axis direction dr1), that is, a so-called propeller fan. The heat-source-side fan 30 mainly includes a fan rotor 50, a bell mouth 65, and a front panel 70.

Figure 7:
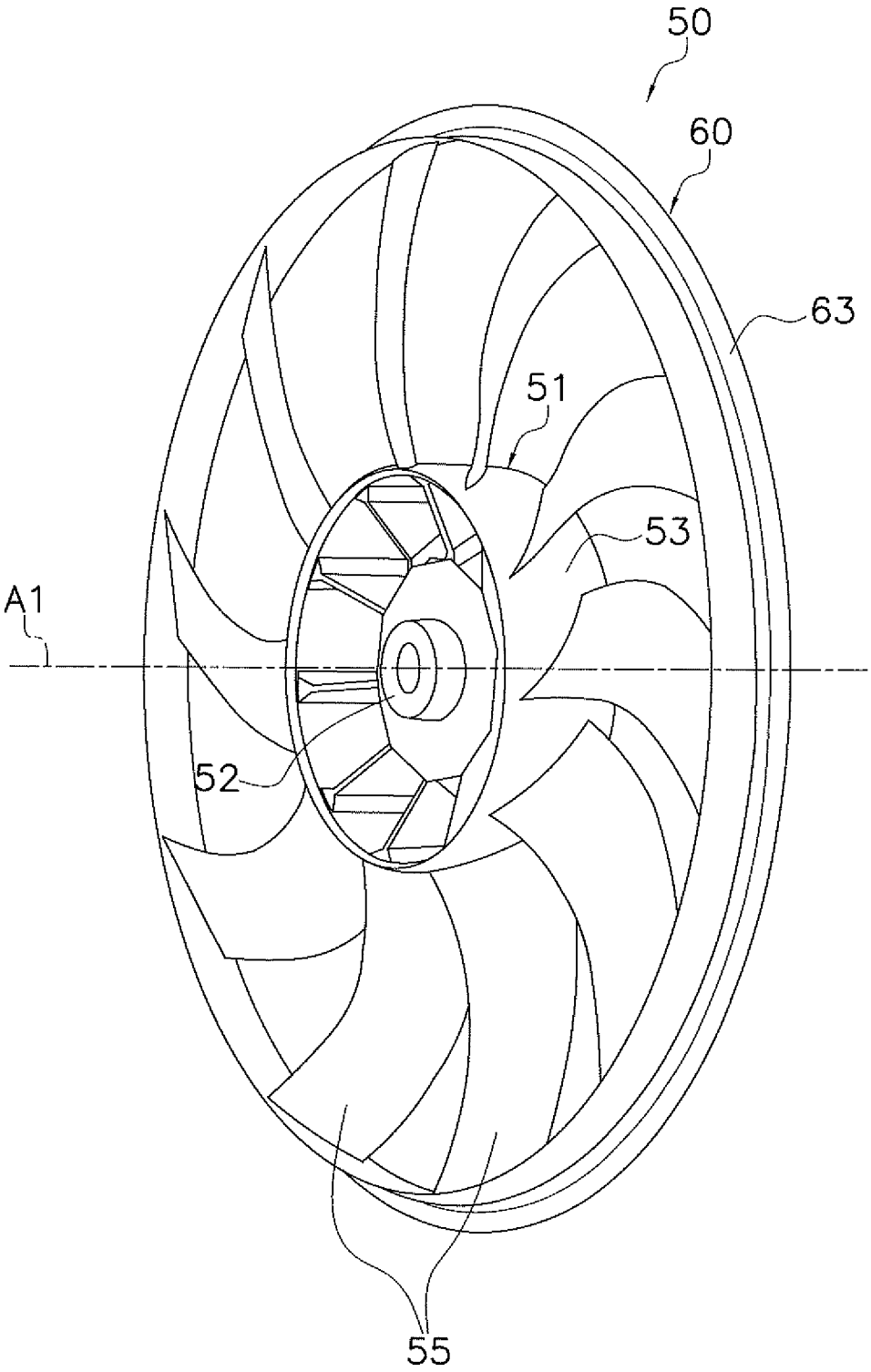
FIG. 7 is a perspective view of a fan rotor as seen from the blow-out side.
Figure 8:
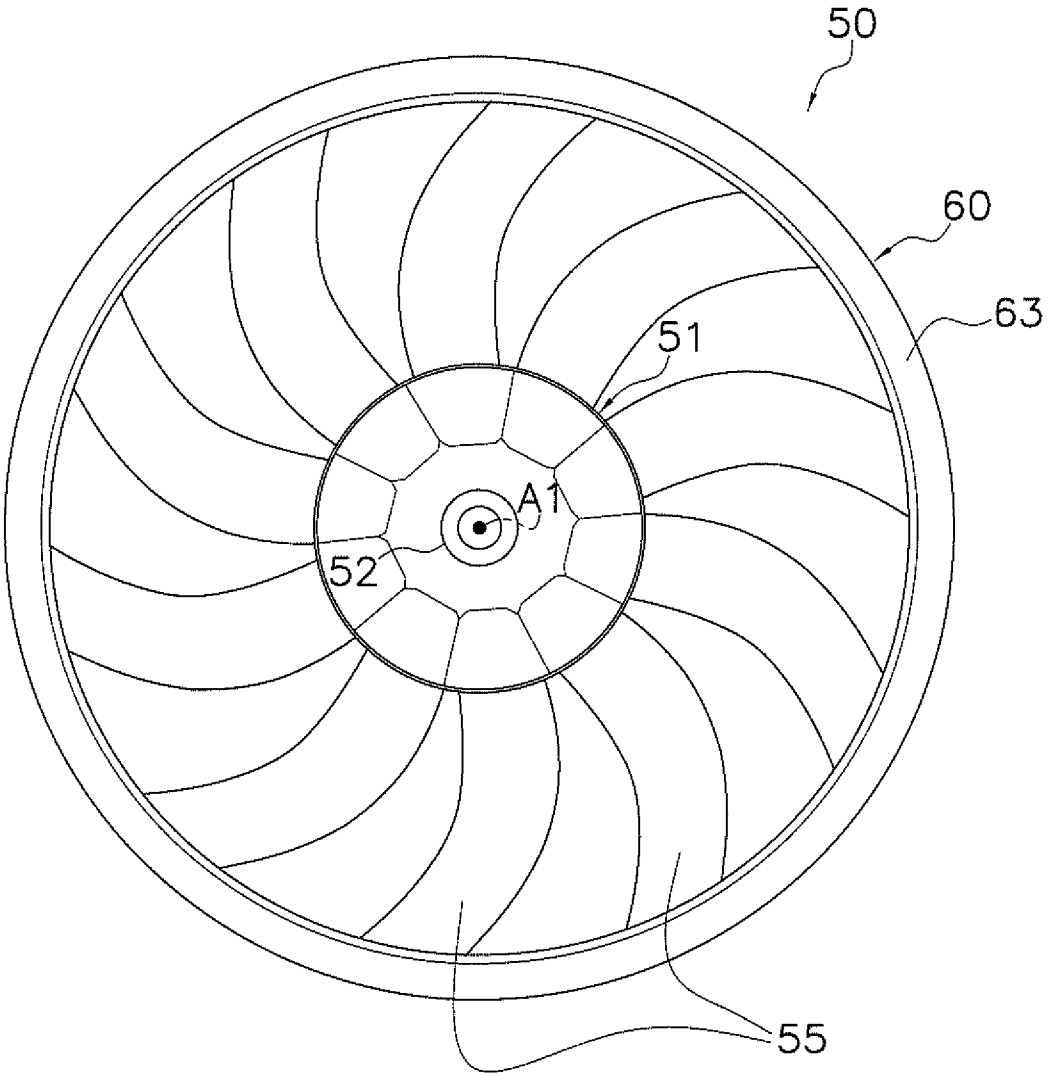
FIG. 8 is a front view of the fan rotor as seen from the blow-out side.
Figure 9:
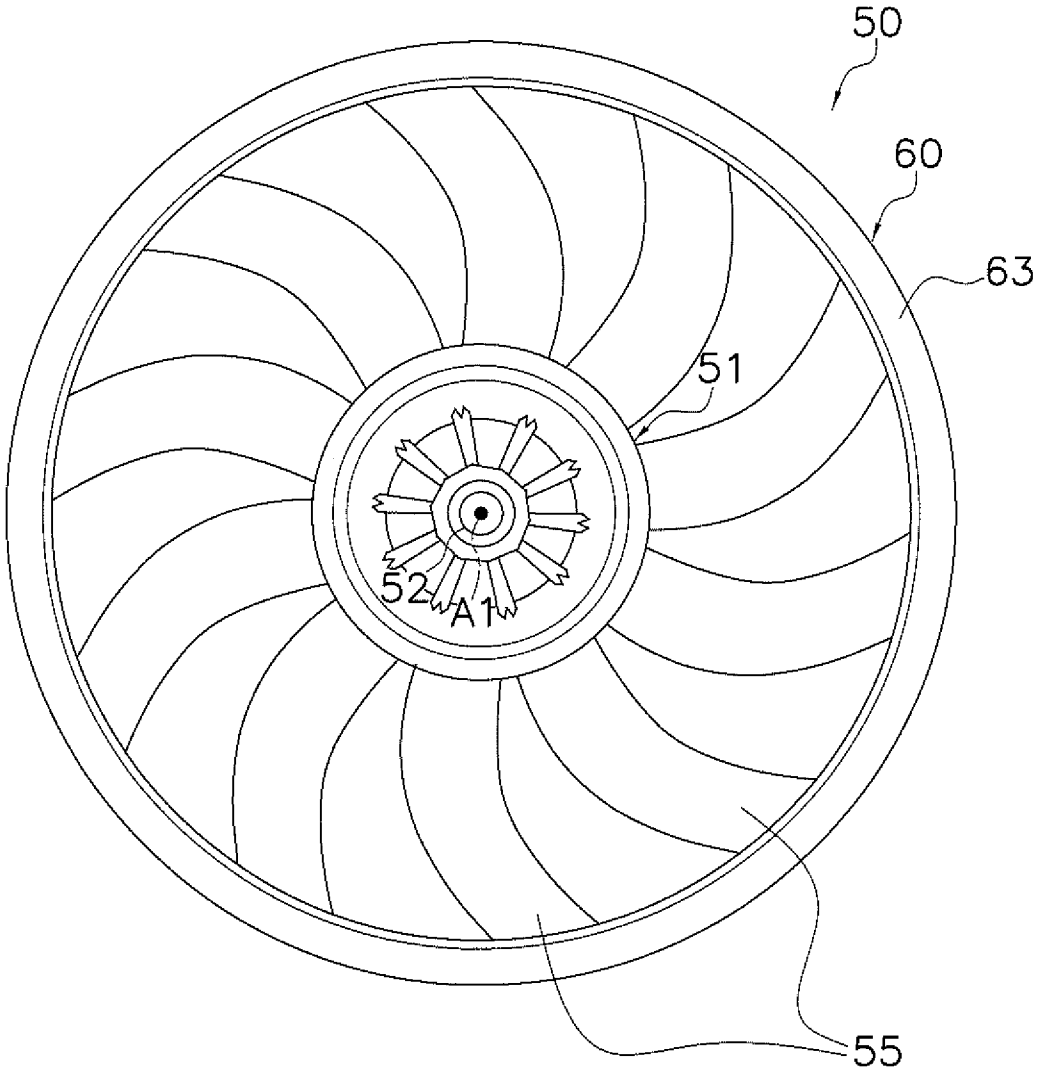
FIG. 9 is a front view of the fan rotor as seen from the intake side.

FIG. 7 is a perspective view of the fan rotor 50 as seen from the blow-out side. FIG. 8 is a front view of the fan rotor 50 as seen from the blow-out side. FIG. 9 is a front view of the fan rotor 50 as seen from the intake side.

In the present embodiment, the dimension of the fan rotor 50 in the rotation axis direction dr1 and the radial direction dr2 is set as appropriate in accordance with the dimension of the heat-source-side heat exchanger 12. The fan rotor 50 includes a core part 51, a plurality (10 pieces in the present embodiment) of blades 55, and a shroud 60 (a ring part).

The core part 51 is annular as seen in the rotation axis direction dr1. The core part 51 includes a bearing part 52, and is mechanically connected to the output shaft of the heat-source-side fan motor M30 in the bearing part 52. The central portion of the core part 51 overlaps with the rotation axis A1. The core part 51 includes a substantially cylindrical side surface part 53 which extends in the rotation axis direction dr1. The side surface part 53 is formed of synthetic resin.

The blades 55 (corresponding to the "vanes" in the claims) extend radially from the core part 51 as seen in the rotation axis direction dr1 (note that, the drawings does not show the reference characters of part of the blades 55). Each of the blades 55 extends in a curved manner from the core part 51 in the radial direction dr2. In more detail, each blade 55 is curved so as to project in the counter-clockwise direction as seen from the blow-out side. The blades 55 are formed of synthetic resin, and have their respective one ends welded to a side surface part 53 of the core part 51. The blades 55 have their respective other ends (tips) welded to the shroud 60.

The shroud 60 (corresponding to the "ring part" in the claims) prevents the outside air (the secondary-side air Fb, see FIG. 10) sent by the blades 55 from reversely flowing from the downstream side (the secondary side) in the outside air flow F1 than the blades 55 to the upstream side (the primary side). The shroud 60 is formed of synthetic resin and ring-like in the rotation axis direction dr1. The shroud 60 is disposed on the radially outer side dr2 relative to the blades 55 (that is, on the outer circumference side), and connected to respective tips of the blades 55. In other words, the shroud 60 covers the blades 55 on the outer circumference side.

The bell mouth 65 (corresponding to the "flow rectifying member" in the claims) is disposed on the downstream side relative to the blades 55, and rectifies the secondary-side air Fb sent from the blades 55 to blow out in the rotation axis direction dr1 (the axial flow direction). The bell mouth 65 is substantially cylindrical and extending in the rotation axis direction dr1 (in more detail, flare-like with its cross section on one end side gradually increasing). The fan rotor 50 is exposed on the downstream side at the opening of the bell mouth 65. The bell mouth 65 is disposed so as to be spaced apart from the shroud 60 in the radial direction dr2. In more detail, part of the bell mouth 65 is positioned on the radially inner side dr2 relative to the shroud 60, and other part of the bell mouth 65 is positioned on the radially outer side dr2 relative to the shroud 60. In the following description, an end of the bell mouth 65 on the upstream side is referred to as a bell mouth upstream side end 66. The bell mouth upstream side end 66 corresponds to the "flow rectifying member end" in the claims.

The front panel 70 is a plate-like member that forms one surface on the blow-out side of the shell of the heat-source-side fan 30. In the present embodiment, the front panel 70 is molded integrally with the bell mouth 65, and continuous to an end of the bell mouth 65 on the downstream side (the blow-out side in the outside air flow F1). The front panel 70 is substantially quadrangular as seen in the rotation axis direction dr1. The front panel 70 is provided with, at its central portion, an annular opening 70*a* for exposing the fan rotor 50 and allowing the outside air flow F1 to blow out. The dimension of the front panel 70 is set as appropriate in accordance with the dimension of the heat-source-side heat exchanger 12. The size of the opening 70*a* is set as appropriate in accordance with the dimension of the fan rotor 50 and the bell mouth 65.

(2-2) Details of Shroud 60 and Positional Relationship between Shroud 60 and Bell Mouth 65

Figure 10:
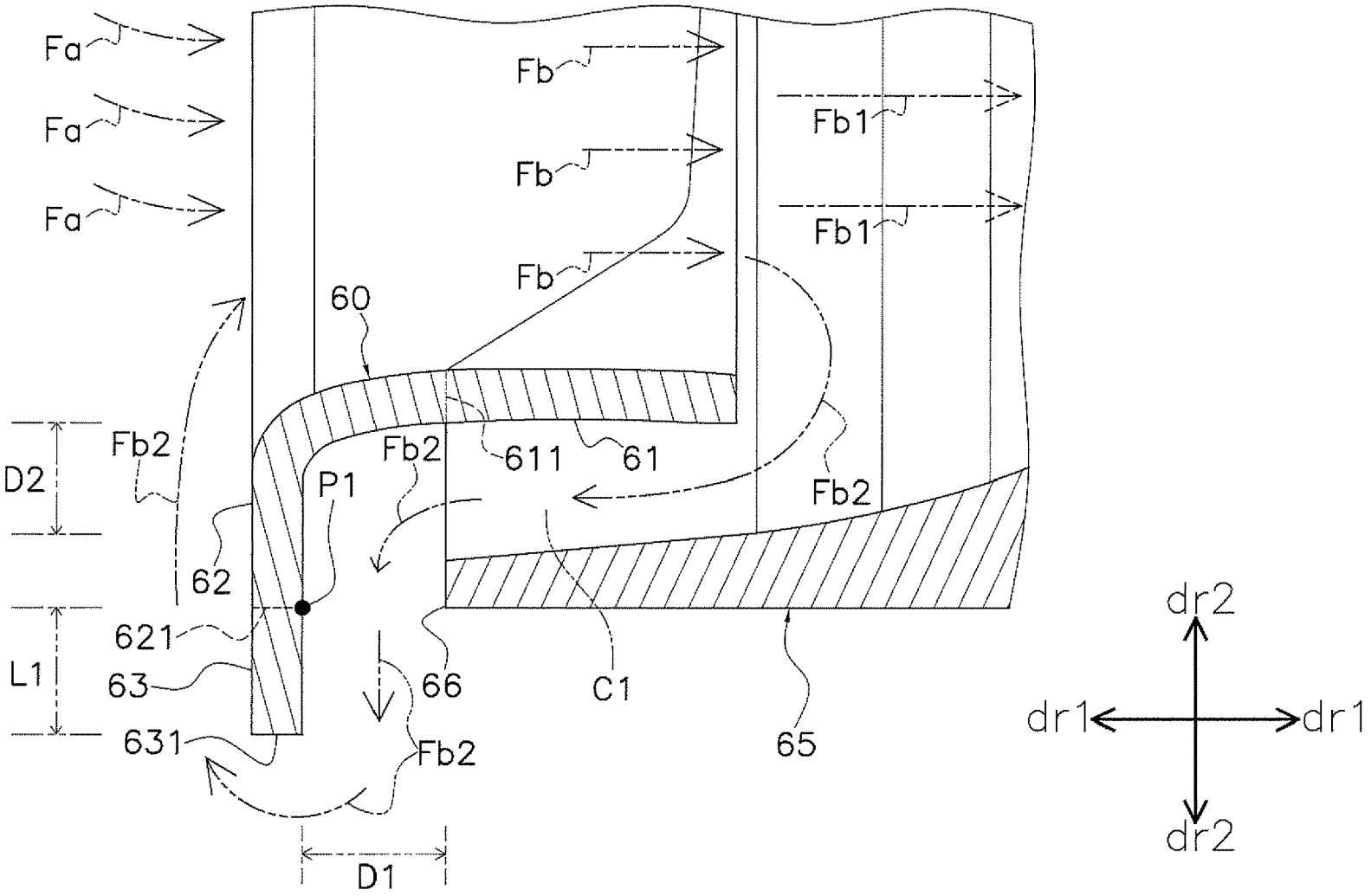
FIG. 10 is an enlarged view of X portion in FIG. 6.

FIG. 10 is an enlarged view of X portion in FIG. 6. As shown in FIG. 10, the cross section of the shroud 60 is substantially L-shaped. In more detail, the shroud 60 is formed so as to extend, from one end overlapping with the bell mouth 65 in the radial direction dr2 on the inner side in the radial direction dr2 (that is, on the inner circumference side) relative to the bell mouth 65, upstream along the rotation axis direction dr1, and then curves toward the radially outer side dr2. The shroud 60 then extends in the radial direction dr2 to reach other end positioned on the radially outer side dr2 relative to the bell mouth 65.

A clearance C1 is formed between the shroud 60 and the bell mouth 65 so as to allow the shroud 60 to rotate with the blades 55. That is, the shroud 60 does not abut on the bell mouth 65, but is displaced from the bell mouth 65 partially in the rotation axis direction dr1 and/or the radial direction dr2.

The shroud 60 mainly includes a first extending part 61 that mainly extends in the rotation axis direction dr1, a second extending part 62 and a third extending part 63 that mainly extend in the radial direction dr2. The first extending part 61, the second extending part 62, and the third extending part 63 are continuous to one another and formed integrally. While no clear boundary exists between the first extending part 61 and the second extending part 62 or between the second extending part 62 and the third extending part 63, for the sake of convenience, the description will be given regarding that the first extending part 61, the second extending part 62, and the third extending part 63 are independent sites.

The first extending part 61 (corresponding to the "first part" in the claims) is a portion that extends from one end overlapping with the bell mouth 65 in the radial direction dr2 on the radially inner side dr2 relative to the bell mouth 65 (that is, an end on the downstream side relative to the shroud 60) toward the upstream side in the rotation axis direction dr1. A first extending part end 611 which is an end of the first extending part 61 on the upstream side (corresponding to the "first end" in the claims) overlaps with the bell mouth upstream side end 66 (an end of the bell mouth 65 on the upstream side) as seen in the radial direction dr2.

The second extending part 62 (corresponding to the "second part" in the claims) is a portion that is connected to the first extending part end 611, extending upstream along the rotation axis direction dr1 then curved toward the radially outer side dr2 and extending toward the radially outer side dr2 along the radial direction dr2. A second extending part end 621 (corresponding to the "second end" in the claims) that is an end on the radially outer side dr2 relative to the second extending part 62 is positioned so as to be spaced apart from the bell mouth upstream side end 66 in the rotation axis direction dr1, and overlaps with the bell mouth 65 as seen in the rotation axis direction dr1. In more detail, the second extending part end 621 overlaps with a virtual point P1, which is virtually disposed at a position reached by the bell mouth upstream side end 66 being linearly extended upstream along the rotation axis direction dr1.

The third extending part 63 (corresponding to the "third part" in the claims) is a portion connected to the second extending part end 621, and extending to other end (an end on the upstream side) of the shroud 60 toward the radially outer side dr2 along the radial direction dr2. The third extending part 63 extends toward the radially outer side dr2, on the radially outer side dr2 than the bell mouth upstream side end 66. In other words, the bell mouth upstream side end 66 is positioned on the radially inner side dr2 relative to the third extending part 63, and the third extending part 63 extends in a direction (here, the radial direction dr2) perpendicular to the extending direction of the bell mouth 65 (the rotation axis direction dr1).

A dimension L1 which is the length in the radial direction dr2 of the third extending part 63 (the first dimension) is at least 0.5 times as great as a distance D1 which is the straight-line distance between the bell mouth upstream side end 66 and the virtual point P1 (that is, the spaced-apart distance between the bell mouth upstream side end 66 and the second extending part end 621). Here, the distance D1 is set in accordance with the dimension of the fan rotor 50 and the bell mouth 65. In the present embodiment, the distance D1 falls within a range of 5 mm to 15 mm inclusive, and the dimension L1 is 4 mm or more. Specifically, the distance D1 is 7 mm, and the dimension L1 is 5 mm. Furthermore, here, a straight-line distance D2 in the radial direction dr2 between one end of the shroud 60 (the end on the downstream side) and the bell mouth 65 is 6 mm.

(3) Improvements in Efficiency of Heat-Source-Side fan 30 and in Performance of Refrigeration Apparatus 100

A fan like the heat-source-side fan 30 is provided with a ring part (in the present embodiment, the shroud 60) which functions as a member for preventing air (in the present embodiment, the secondary-side air Fb) sent by vanes (in the present embodiment, the blades 55) from reversely flowing from the downstream side (the secondary side) relative to the vanes to the upstream side (the primary side). Here, since the ring part rotates with the vanes, a flow rectifying member (in the present embodiment, the bell mouth 65) must be disposed so as not to overlap with the rotation orbit of the ring part, and a clearance (in the present embodiment, the clearance C1) must be formed between the ring part and the flow rectifying member. The clearance communicates with the primary side and the air on the secondary side is greater in pressure than the primary side. Therefore, instead of passing through the flow rectifying member, part of the air on the secondary side flows reversely to the primary side passing through the clearance. That is, despite the provision of the ring part for preventing backflow, part of the air on the secondary side reversely flows to the primary side.

The air reversely flowed to the primary side (the backflow air) merges with the air taken into the fan rotor 50 (the intake air) (that is, a short-circuit occurs). As the flow rate of the backflow air (the backflow volume) is greater, the airflow volume blown out from the fan becomes smaller, which means that the efficiency of the fan reduces.

Figure 11:
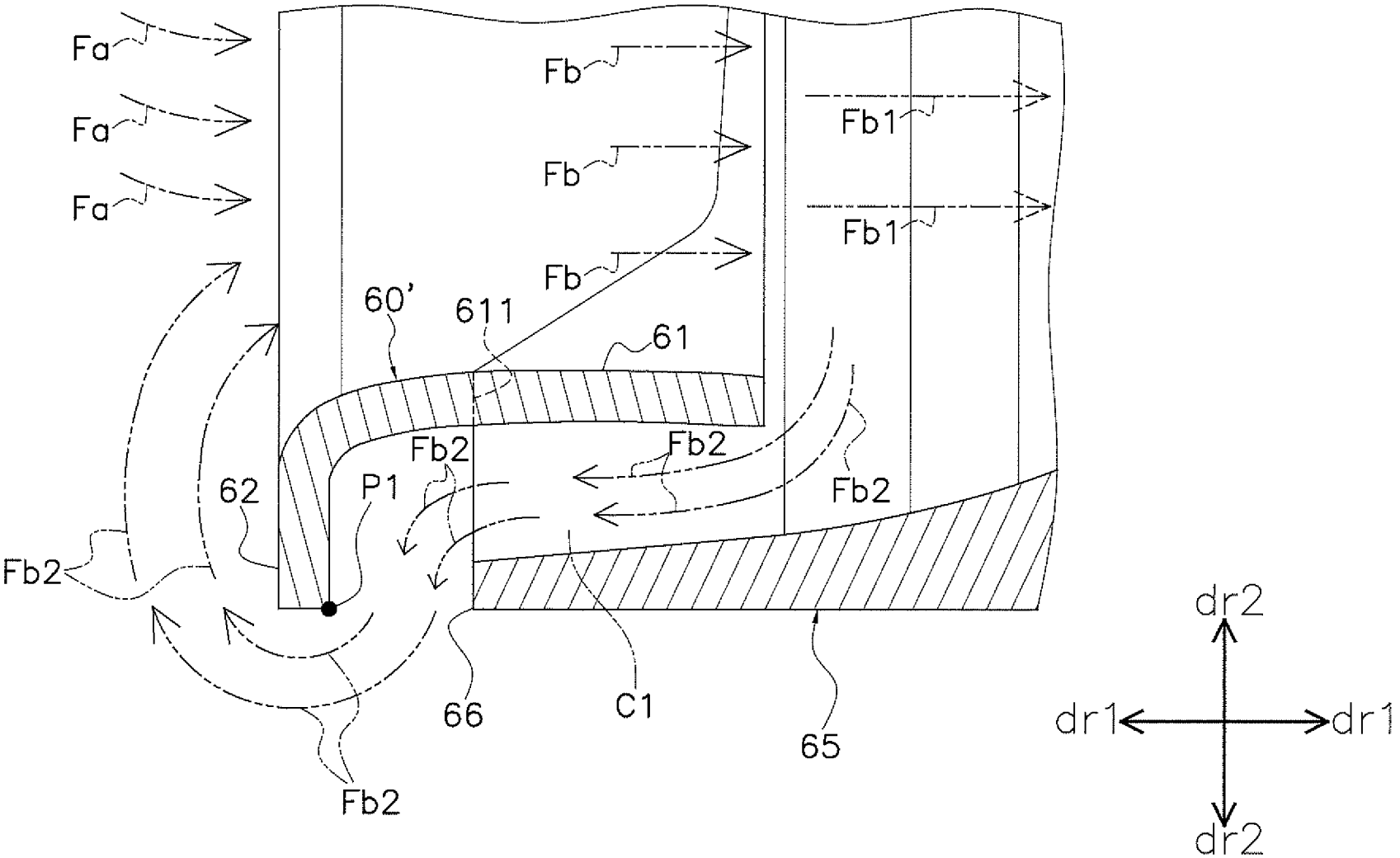
FIG. 11 is a schematic diagram showing the state where a shroud in FIG. 10 is replaced by a shroud not including a third extending part.

FIG. 11 is a schematic diagram showing the state where the shroud 60 in FIG. 10 is replaced by a shroud 60' not including the third extending part 63. Being different from the shroud 60, the shroud 60' does not include the third extending part 63 and, therefore, its cross section is substantially J-shaped.

As described above, the heat-source-side fan 30 in operation generates the outside air flow F1. As shown in FIGS. 10 and 11, the blades 55 send the primary side air (the intake air) Fa as the secondary-side air Fb to the secondary side. The flow of the secondary-side air Fb is rectified by the bell mouth 65 and blown out from the opening 70*a* as the blow-out air Fb1. Part of the secondary-side air Fb is not blown out from the opening 70*a* and instead flows as the backflow air Fb2 in the radial direction dr2 (specifically, in the centrifugal direction) via the clearance C1, and merges with the primary side air Fa. Note that, the double-dashed arrows representing the flow of air in FIGS. 10 and 11 are merely a schematic illustration for the sake of convenience. The backflow actually mainly travels in the centrifugal direction and then merges with the intake air.

As shown in FIG. 11, when the third extending part 63 is not provided, the length extending on the radially outer side dr2 of the shroud 60' is less than half the distance D1 which is the straight-line distance between the bell mouth upstream side end 66 and the virtual point P1. When the backflow air Fb2 reversely flowing on the radially outer side dr2 via the clearance C1 flows toward the location where the backflow air Fb2 merges with the primary side air Fa, the flow path resistance is small. Consequently, as compared to the shroud 60 including the third extending part 63, with the shroud 60', the secondary-side air Fb tends to reversely flow and the backflow volume is great.

In contrast, in the heat-source-side fan 30, the shroud 60 includes the third extending part 63 that extends from the second extending part end 621 on the radially outer side dr2 along the radial direction dr2 to reach other end of the shroud 60. The dimension L1 (the length in the radial direction dr2 of the third extending part 63) is at least 0.5 times as great as the distance D1 (the straight-line distance between the bell mouth upstream side end 66 and the virtual point P1). That is, the third extending part 63 greatly covers the bell mouth upstream side end 66 on the upstream side.

With the shroud 60 including the third extending part 63, when the backflow air Fb2 reversely flowing on the radially outer side dr2 via the clearance C1 flows toward the location where the backflow air Fb2 merges with the primary side air Fa, the backflow air Fb2 greatly detours (that is, the distance between the exit of the backflow air Fb2 and the point where the backflow air Fb2 merges with the primary side air Fa becomes great), and the flow path resistance increases. Consequently, as compared to the shroud 60' not including the third extending part 63, with the shroud 60, the secondary-side air Fb becomes less prone to reversely flow and the backflow volume is minimized. By virtue of the minimized backflow volume, the heat-source-side fan 30 including such a shroud 60 is improved in yield and efficiency than conventional fans.

Figure 12:
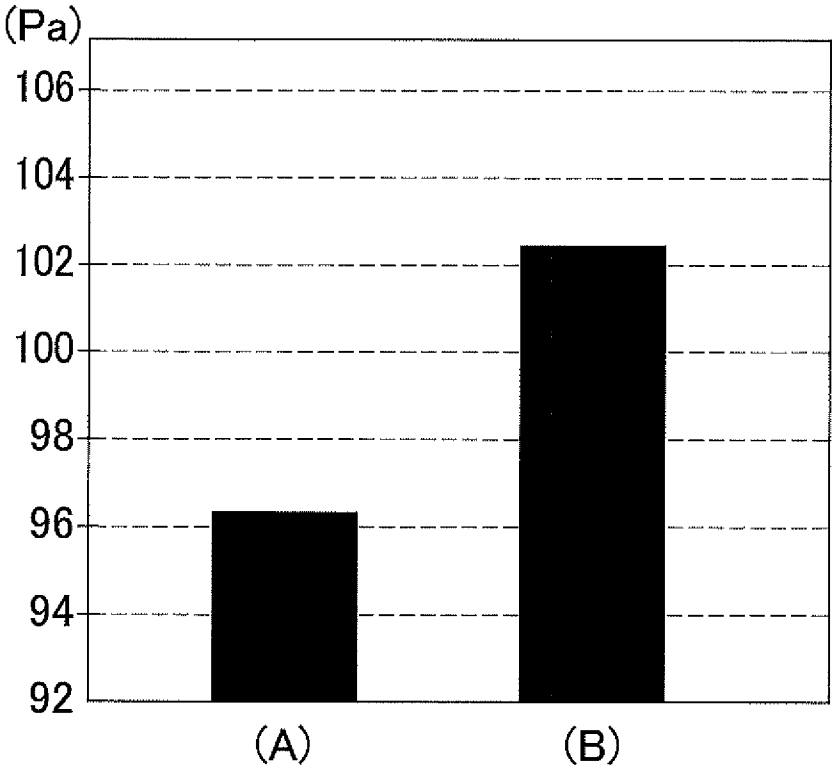
FIG. 12 is a graph showing an exemplary pressure gain when the fan including the shroud shown in FIG. 10 and the fan including the shroud shown in FIG. 11 operate under an identical condition.

FIG. 12 is a graph showing an exemplary pressure gain when the fan including the shroud 60 in FIG. 10 and the fan including the shroud 60' in FIG. 11 operate under an identical condition. FIG. 12 is based on an analysis result. (A) shows the pressure gain of the fan including the shroud 60' in FIG. 11, and (B) shows the pressure gain of the fan including the shroud 60 in FIG. 10.

FIG. 12 shows that the pressure gain of the fan including the shroud 60' is 96.32 (Pa), and the pressure gain of the fan including the shroud 60 is 102.38 (Pa). That is, it can be seen that the fan including the shroud 60 is greater than the fan including the shroud 60' in pressure gain, yield and airflow volume per unit time. The refrigeration apparatus 100 including the heat-source-side fan 30 including such a shroud 60 provides an improved heat exchange amount of the heat-source-side heat exchanger 12 and, consequently, the refrigeration apparatus 100 exhibits improved performance.

(4) Characteristic (4-1)

In the above-described embodiment, in the heat-source-side fan 30, the shroud 60 includes the third extending part 63. The third extending part 63 is connected to the second extending part end 621 which overlaps with the virtual point P1 which can be reached by the bell mouth upstream side end 66 being linearly extended on the upstream side along the rotation axis direction dr1. The third extending part 63 extends along the radial direction dr2 on the radially outer side dr2 than the bell mouth upstream side end 66. The dimension L1 (the length in the radial direction dr2 of the third extending part 63) is at least 0.5 times as great as the distance D1 (the straight-line distance between the bell mouth upstream side end 66 and the virtual point P1). That is, the third extending part 63 extends, by the length corresponding to at least half the clearance formed between the shroud 60 and the bell mouth 65, on the radially outer side dr2 than the bell mouth upstream side end 66.

Thus, the third extending part 63 greatly detours the backflow air Fb2 (the air that reversely flows through the clearance C1 formed between the shroud 60 and the bell mouth 65) flowing toward the point where it merges with the intake air (the primary side air Fa taken into the fan). This ensures a great flow path resistance on the backflow air Fb2 flowing toward the merging point. Consequently, the backflow volume (the flow rate of the backflow air Fb2) per unit time reduces. Hence, the heat-source-side fan 30 exhibits improved efficiency.

(4-2)

In the above-described embodiment, in the heat-source-side fan 30, the third extending part 63 extends in the direction perpendicular to the extending direction of the bell mouth 65. This simple configuration greatly detours the backflow air Fb2 flowing toward the point where it merges with the intake air. Consequently, the backflow volume is minimized at lower costs.

(4-3)

In the above-described embodiment, in the heat-source-side fan 30, the flow rectifying member is the bell mouth 65 disposed on the downstream side relative to the blades 55. This configuration greatly detours the backflow air Fb2 flowing through the clearance C1 between the shroud 60 and the bell mouth 65 disposed on the blow-out side of the blades 55. Hence, the heat-source-side fan 30 including the bell mouth 65 and the shroud 60 exhibits improved efficiency.

(4-4)

In the above-described embodiment, in the heat-source-side fan 30, the distance D1 is 7 mm (that is, falls within a range of 5 mm to 15 mm inclusive), and the dimension L1 is 5 mm (that is, 4 mm or more). This configuration surely detours the backflow air Fb2 flowing toward the point where it merges with the intake air while minimizing an increase in size of the heat-source-side fan 30.

(4-5)

In the above-described embodiment, the heat-source-side fan 30 is an axial flow fan that sends air in the rotation axis direction dr1. The axial flow fan including the shroud 60 (the ring part) and the bell mouth 65 (the flow rectifying member) exhibits improved efficiency.

(4-6)

In the above-described embodiment, by virtue of the improved efficiency of the heat-source-side fan 30, the heat exchange amount by the heat-source-side heat exchanger 12 increases. Hence, the refrigeration apparatus 100 exhibits improved efficiency.

(5) Variation

As shown in the following variations, the above-described embodiment can be modified as appropriate. Note that, the variations may be combined with each other unless they become contradictory to each other.

(5-1) Variation A

Figure 13:
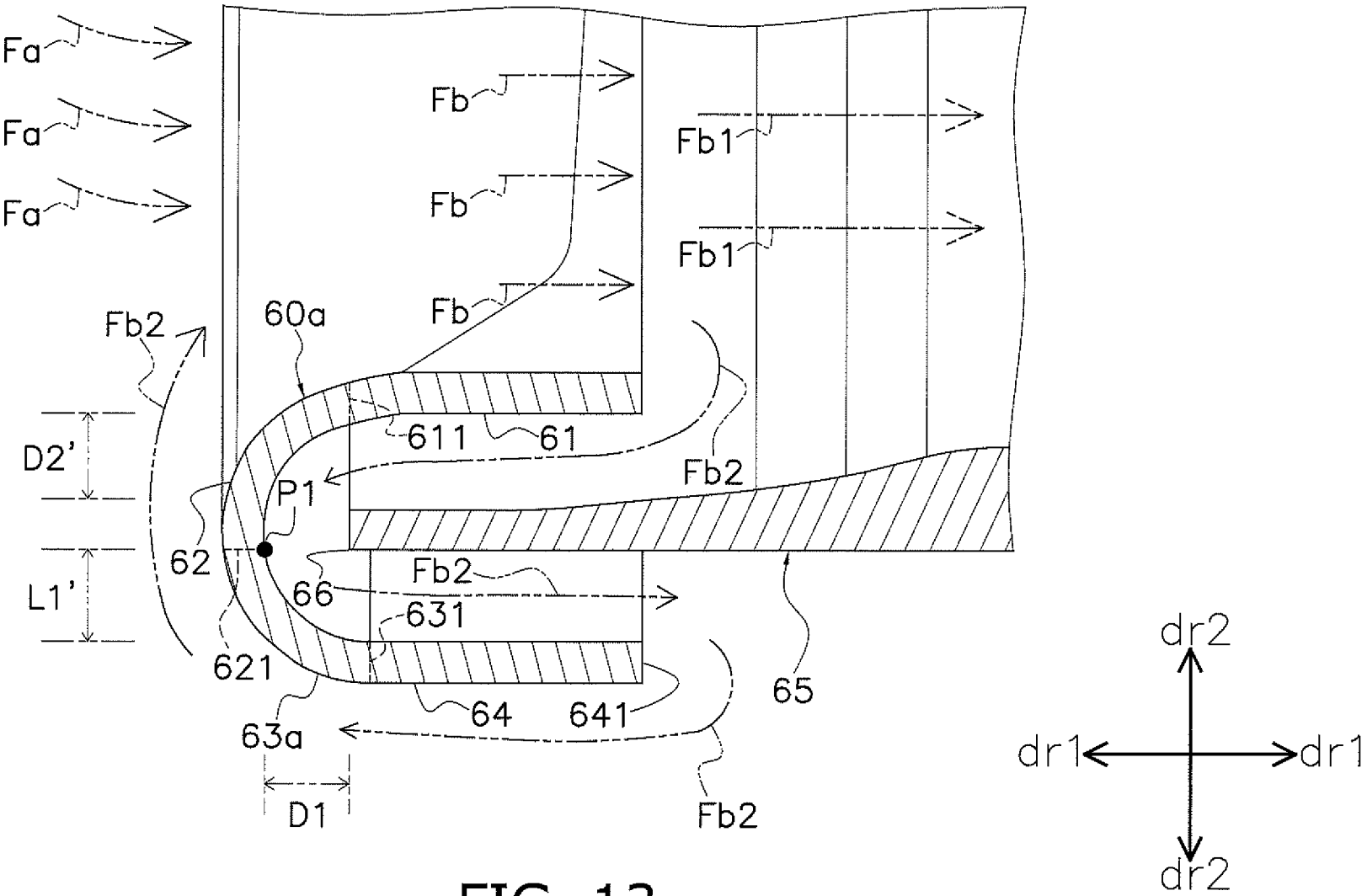
FIG. 13 is a schematic diagram showing the state where the shroud in FIG. 10 is replaced by a shroud according to a variation A.

In the above-described embodiment, while the heat-source-side fan 30 includes the shroud 60 as shown in FIG. 10, the shroud 60 may be replaced by a shroud 60*a* whose cross section is U-shaped as shown in FIG. 13.

The shroud 60*a* includes, in place of the third extending part 63, a third extending part 63*a*, and includes a fourth extending part 64 which extends toward the downstream side along the rotation axis direction dr1.

The third extending part 63*a* extends along the radial direction dr2 on the radially outer side dr2 than the bell mouth upstream side end 66, and then extends along the rotation axis direction dr1. In more detail, the third extending part 63*a* extends toward the radially outer side dr2 from the point where the third extending part 63*a* is connected to the second extending part end 621, while being curved toward the downstream side along the rotation axis direction dr1. A third extending part end 631 which is an end of the third extending part 63*a* on the downstream side is positioned on the downstream side than the bell mouth upstream side end 66, and the third extending part 63*a* overlaps with the bell mouth upstream side end 66 as seen in the radial direction dr2.

The fourth extending part 64 extends, on the radially outer side dr2 relative to the bell mouth 65, from the third extending part end 631 toward the downstream side along the rotation axis direction dr1. The fourth extending part 64 includes a fourth extending part end 641 that overlaps with the first extending part 61 (specifically, an end of the shroud 60*a* on the downstream side) as seen from the radial direction dr2. That is, the fourth extending part 64 is disposed such that the bell mouth 65 is partially interposed between the fourth extending part 64 and the first extending part 61. The fourth extending part end 641 corresponds to other end of the shroud 60*a* (an end opposite to the downstream side end).

With such a shroud 60*a* also, a dimension L1' which is the length in the radial direction dr2 of the third extending part 63*a* is at least 0.5 time as great as the distance D1 which is the straight-line distance between the bell mouth upstream side end 66 and the virtual point P1. That is, the third extending part 63*a* greatly covers the bell mouth upstream side end 66 on the upstream side.

With such a third extending part 63*a* also, as compared to the shroud 60' in FIG. 11, the backflow air Fb2 reversely flowing toward the radially outer side dr2 via the clearance C1 greatly detours when flowing toward the location where it merges with the primary side air Fa. The flow path resistance on the backflow air Fb2 becomes great.

In particular, the shroud 60*a* includes the fourth extending part 64 connected to the third extending part end 631 and extending toward the downstream side along the rotation axis direction dr1, on the radially outer side dr2 relative to the bell mouth 65. That is, the fourth extending part 64 covers the bell mouth upstream side end 66 on the radially outer side dr2. Thus, as compared to the shroud 60, this configuration provides a greater area of a portion serving as the resistance on the backflow air Fb2. The backflow air Fb2 further greatly detours (that is, the distance between the exit of the backflow air Fb2 and the location where it merges with the primary side air Fa becomes greater), whereby the flow path resistance becomes greater. Consequently, with the shroud 60*a*, the secondary-side air Fb becomes more unlikely to reversely flow, and the backflow volume is further minimized.

With such a shroud 60*a*, the particularly minimized backflow volume further improves the yield of the heat-source-side fan 30 as compared to the fan with the shroud 60. That is, the fan exhibits improved performance.

Figure 14:
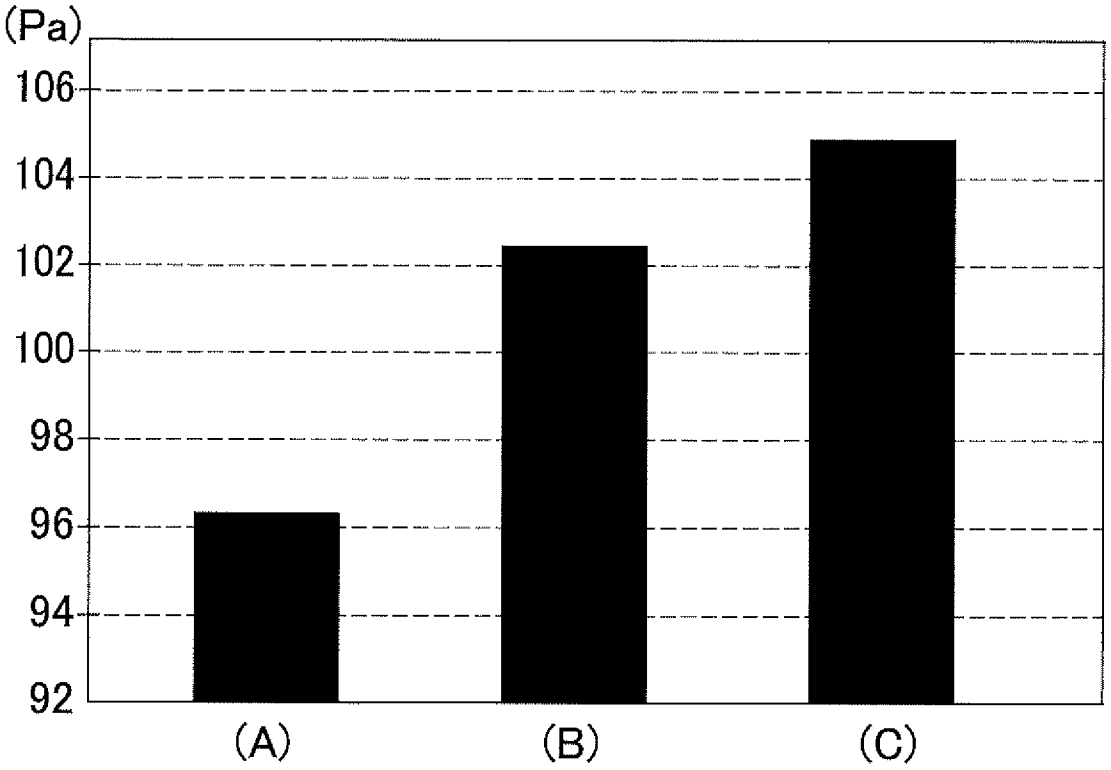
FIG. 14 is a graph showing an exemplary pressure gain when the fan including the shroud in FIG. 10, the fan including the shroud in FIG. 11, and the fan including the shroud in FIG. 13 operate under an identical condition.

FIG. 14 is a graph showing an exemplary pressure gain when the fan including the shroud 60 in FIG. 10, the fan including the shroud 60' in FIG. 11, and the fan including the shroud 60*a* in FIG. 13 operate under an identical condition. FIG. 14 is based on an analysis result. (A) shows the pressure gain of the fan including the shroud 60' in FIG. 11, (B) shows the pressure gain of the fan including the shroud 60 shown in FIG. 10, and (C) shows the pressure gain of the fan including the shroud 60*a* in FIG. 13.

FIG. 14 shows that the pressure gain of the fan including the shroud 60' is 96.32 (Pa), the pressure gain of the fan including the shroud 60 is 102.38 (Pa), and the pressure gain of the fan including the shroud 60*a* is 104.94 (Pa). That is, it can be seen that the fan including the shroud 60*a* is greater than the fan including the shroud 60' and the fan including the shroud 60 in the pressure gain, the yield and the airflow volume per unit time.

(5-2) Variation B

In the above-described embodiment, the third extending part 63 extends in the direction perpendicular to the extending direction of the bell mouth 65. However, so long as the third extending part 63 extends in the direction crossing the extending direction of the bell mouth 65 on the upstream side of the bell mouth upstream side end 66 such that the distance between the exit of the backflow air Fb2 and the location where the backflow air Fb2 merges with the primary side air Fa becomes great, the third extending part 63 may not extend in the direction perpendicular to the extending direction of the bell mouth 65.

(5-3) Variation C

In the above-described embodiment, the description has been given of the case where, in the shroud 60, the first extending part 61, the second extending part 62, and the third extending part 63 are continuous to one another (that is, in the case where they are molded integrally). However, the shroud 60 may not be configured in such a manner, and may be configured by all or part of the separately formed first extending part 61, second extending part 62 and third extending part 63 being joined as appropriate.

(5-4) Variation D

In the above-described embodiment, the description has been given of the case where, in order to minimize the backflow volume of the backflow air Fb2 via the clearance C1 between the flow rectifying member (the bell mouth 65 disposed on the downstream side relative to the blades 55) and the ring part (the shroud 60), the third extending part 63 is disposed on the upstream side relative to the upstream side end of the flow rectifying member (the bell mouth upstream side end 66).

However, the technical idea of the present invention is applicable to other environment as appropriate. For example, when the fan includes the flow rectifying member disposed on the upstream side relative to the blades 55, in order to minimize the backflow volume of the backflow air via the clearance between the flow rectifying member and the ring part, the ring part may be provided with an extending part corresponding to the third extending part 63 (specifically, similarly to the third extending part 63 according to the above-described embodiment, the extending part that greatly covers the upstream side of the upstream side end of the flow rectifying member).

(5-5) Variation E

In the above-described embodiment, the description has been given of the case where the distance D1 is 7 mm and the dimension L1 is 5 mm. However, the value of the distance D1 or the dimension L1 is not limited to such values, and may be changed as appropriate in accordance with the design specification or the installation environment. For example, the distance D1 may be 6 mm (that is, less than 7 mm), or 8 mm (that is, 8 mm or more). For example, the dimension L1 may be 4 mm (that is, less than 5 mm), or 6 mm (that is, 6 mm or more).

In the above-described embodiment, the description has been given of the case where the distance D1 falls within a range of 5 mm to 15 mm inclusive and the dimension L1 is 4 mm or more. However, the value of the distance D1 or the dimension L1 may not be set on the basis of such a numerical value range, and may be set on the basis of other numerical value range in accordance with the design specification or the installation environment. Note that, in view of minimizing the backflow volume, the clearance between the ring part and the flow rectifying member is preferably small. The distance D1 is preferably 15 mm or less. On the other hand, in view of smooth rotation of the ring part, the distance D1 is preferably 5 mm or more.

(5-6) Variation F

In the above-described embodiment, the heat-source-side fan 30 is coupled to the heat-source-side heat exchanger 12 which has four heat exchange surfaces and whose cross section is substantially quadrangular. However, the heat-source-side fan 30 may not be coupled to a heat exchanger which has four heat exchange surfaces and whose cross section is substantially quadrangular. The heat-source-side fan 30 may be coupled to a heat exchanger of other shape (for example, which has three or less or five or more heat exchange surfaces and whose cross section is substantially L-shaped, U-shaped or polygonal). Furthermore, the heat-source-side fan 30 may not be coupled to a heat exchanger, and may be independently disposed.

(5-7) Variation G

In the above-described embodiment, the core part 51 (the side surface part 53), the blades 55, and the shroud 60 are formed of synthetic resin. However, the core part 51, the blades 55 and/or the shroud 60 may not be formed of synthetic resin, and may be formed of other material (for example, metal).

In the above-described embodiment, the description has been given of the case where the fan rotor 50 is formed by the core part 51, the blades 55, and the shroud 60 are welded to one another. However, the configuration of the fan rotor 50 is not limited thereto. The core part 51, the blades 55, and/or the blades 55 and the shroud 60 may be connected to each other by other scheme (for example, brazing). Any of or all the core part 51, the blades 55, and the shroud 60 may be molded integrally. In this case, in manufacturing the fan rotor 50, the step of connecting the core part 51 and the blades 55, and/or the blades 55 and the shroud 60 is eliminated.

(5-8) Variation H

In the above-described embodiment, the bell mouth 65 is molded integrally with the front panel 70. The downstream side end of the bell mouth 65 and the front panel 70 are continuous to each other. However, the bell mouth 65 may not be molded integrally with the front panel 70, and may be formed separately. In this case, the bell mouth 65 should be joined with the front panel 70 as appropriate.

(5-9) Variation I

In the above-described embodiment, the fan rotor 50 has ten blades 55. However, the number of the blades 55 may be changed as appropriate in accordance with the design specification or the installation environment. For example, the blades 55 may be four in number (less than ten), or twelve in number (eleven or more).

(5-10) Variation J

In the above-described embodiment, the shroud 60 is ring-shaped. However, so long as the shroud 60 is rotatable with the blades 55, the shroud 60 may not be ring-shaped and may have other shape. For example, the shroud 60 may be formed to be polygonal as seen in the rotation axis direction dr1.

(5-11) Variation K

In the above-described embodiment, the present invention is applied to the heat-source-side fan 30 which is an axial flow fan which sends air in the axial flow direction, that is, a so-called propeller fan. However, the type or kind of the fan to which the present invention is applied may be changed as appropriate in accordance with the design specification or the installation environment. For example, the present invention is applicable not just to a propeller fan, and may be applied to other fan (for example, a turbofan). Furthermore, the present invention is applicable not just to an axial flow fan. So long as the technical idea of the invention is applicable, the present invention is applicable to a centrifugal fan which sends air in the centrifugal direction relative to the axial flow direction, a mixed flow fan which diagonally sends air relative to the axial flow direction, or a tangential fan which sends air in the direction different from the air intake direction.

(5-12) Variation L

The configuration of the refrigerant circuit RC according to the above-described embodiment may be changed as appropriate in accordance with the installation environment or the design specification. Specifically, in the refrigerant circuit RC, part of the circuit elements may be replaced by other element or may be omitted as appropriate when not essential. The refrigerant circuit RC may include any elements or refrigerant flow paths not shown in FIG. 1.

(5-13) Variation M

In the above-described embodiment, the present invention is applied to the heat-source-side fan 30. However, the present invention is also applicable to a fan other than the heat-source-side fan 30 as appropriate. For example, the technical idea of the present invention may be applied to the service-side fan 31.

Furthermore, in the above-described embodiment, the present invention is applied to the fan included in the refrigeration apparatus 100 which cools the target space 51 such as the inside of a low-temperature warehouse, the inside of a transfer container, or the inside of a showcase at a shop. However, the present invention is also applicable to a fan included in other refrigeration apparatus provided with a refrigerant circuit. For example, the present invention is applicable to a fan included in a refrigeration apparatus that heats or maintains the temperature of the target space 51 (that is, a refrigeration apparatus in which the heat-source-side heat exchanger 12 functions as an evaporator or a heater for a refrigerant), an air conditioning system that conditions air by cooling a living space or the cabin of a vehicle, a hot water supply apparatus, a heat pump chiller or the like.

Furthermore, the present invention is also applicable to a fan included in an apparatus other than a refrigeration apparatus. For example, the present invention may be applied to a fan included in an air conditioning apparatus such as an air purifier, a humidifier, or a ventilator. For example, the present invention may be applied to a fan included in any of various apparatuses such as a vacuum cleaner, a hair dryer and the like.

(5-14) Variation N

In the above-described embodiment, the drive source of the heat-source-side fan 30 is a motor (the heat-source-side fan motor M30). However, the drive source of the fan to which the present invention is applied is not limited to a motor, and may be changed as appropriate in accordance with the design specification or the installation environment. For example, the drive source of the fan may be an engine.

The present invention is applicable to a fan or a refrigeration apparatus including the fan.

What is claimed is:

1. A fan comprising:

a core part connected to a drive source;

a plurality of vanes radially extending from the core part as seen along a rotation axis direction;

a ring part, the ring part being ring shaped as seen along the rotation axis direction, and the ring part being connected to respective tips of the vanes on a radially outer side relative to the vanes; and a flow rectifying member disposed spaced apart from the ring part in a radial direction perpendicular to the rotation axis direction, the flow rectifying member being a cylindrical member extending along the rotation axis direction, and the flow rectifying member being configured to rectify air sent by the vanes, the ring part including a first part including a first end overlapping with a flow rectifying member end that is an upstream side end of the flow rectifying member as seen along the radial direction, and the first part extending along the rotation axis direction on a radially inner side relative to the flow rectifying member, a second part including a second end spaced apart in the rotation axis direction from the flow rectifying member end, the second end overlapping with the flow rectifying member as seen along the rotation axis direction, the second part being connected to the first end, and the second part extending along the radial direction to reach the second end, and a third part connected to the second end, the third part extending linearly along the radial direction on the radially outer side relative to the flow rectifying member end, the second end overlapping with a virtual point, the virtual point lying on a virtual line extending from the flow rectifying member end toward the second part along the rotation axis direction, and a first dimension being a length in the radial direction of the third part, the first dimension being at least 0.5 times a first distance that is a straight-line distance between the flow rectifying member end and the virtual point.

2. The fan according to claim 1, wherein the flow rectifying member is a bell mouth disposed on a downstream side relative to the vanes.

3. The fan according to claim 1, wherein the first distance is 5 mm to 15 mm, and the first dimension is 4 mm or more.

4. The fan according to claim 1, wherein the fan is an axial flow fan configured to send air along the rotation axis direction.

5. A refrigeration apparatus including the fan according to claim 1, the refrigeration apparatus further comprising:

a heat exchanger including a heat transfer pipe through which a refrigerant flows, the heat exchanger being configured to allow an air flow generated by the fan to exchange heat with the refrigerant.

6. The fan according to claim 2, wherein the first distance is 5 mm to 15 mm, and the first dimension is 4 mm or more.

7. The fan according to claim 2, wherein the fan is an axial flow fan configured to send air along the rotation axis direction.

8. The fan according to claim 3, wherein the fan is an axial flow fan configured to send air along the rotation axis direction.

* * * * *